US008759730B2

(12) United States Patent
Neff et al.

(10) Patent No.: US 8,759,730 B2
(45) Date of Patent: Jun. 24, 2014

(54) MICROWAVEABLE CARTON HAVING MULTIPLE FOCUSED SUSCEPTORS

(75) Inventors: Gary Neff, Pittsburgh, PA (US); Eric Sitterly, Mars, PA (US); Stephen James DeNio, Pittsburgh, PA (US); Akou Amefia, Cranberry Township, PA (US); Randy Gunzburger, Irwin, PA (US)

(73) Assignee: H.J. Heinz Company, Pittsburgh, PA (US)

( * ) Notice: Subject to any disclaimer, the term of this patent is extended or adjusted under 35 U.S.C. 154(b) by 694 days.

(21) Appl. No.: 12/564,614

(22) Filed: Sep. 22, 2009

(65) Prior Publication Data

US 2010/0072197 A1 Mar. 25, 2010

Related U.S. Application Data

(60) Provisional application No. 61/136,644, filed on Sep. 22, 2008.

(51) Int. Cl.
*H05B 6/80* (2006.01)

(52) U.S. Cl.
USPC ..... 219/730; 493/52

(58) Field of Classification Search
USPC ..... 219/730; 493/52; 428/119
See application file for complete search history.

(56) References Cited

U.S. PATENT DOCUMENTS

| | | | | |
|---|---|---|---|---|
| 4,133,896 | A | | 1/1979 | Standing et al. |
| 4,165,855 | A | | 8/1979 | Mason |
| 4,172,903 | A | | 10/1979 | Daswick |
| 4,592,914 | A | | 6/1986 | Kuchenbecker |
| 4,626,641 | A | * | 12/1986 | Brown ..... 219/729 |
| 4,661,671 | A | * | 4/1987 | Maroszek ..... 219/730 |
| 4,705,929 | A | | 11/1987 | Atkinson |
| 4,785,160 | A | * | 11/1988 | Hart ..... 219/730 |
| 4,864,089 | A | | 9/1989 | Tighe et al. |
| 4,877,932 | A | | 10/1989 | Bernstein et al. |
| 4,914,266 | A | * | 4/1990 | Parks et al. ..... 219/730 |
| 4,927,991 | A | | 5/1990 | Wendt et al. |
| 5,038,009 | A | | 8/1991 | Babbitt |
| 5,153,402 | A | | 10/1992 | Quick et al. |
| 5,247,149 | A | | 9/1993 | Peleg |

(Continued)

FOREIGN PATENT DOCUMENTS

| | | |
|---|---|---|
| CN | 1918044 A | 2/2007 |
| EP | 0 417 316 | 3/1991 |

(Continued)

OTHER PUBLICATIONS

Japanese Office Action issued in counterpart Japanese application No. 2011-527829 dated Mar. 26, 2013 (13 pages).

(Continued)

*Primary Examiner* — Andy Huynh
*Assistant Examiner* — Sitaramarao S Yechuri
(74) *Attorney, Agent, or Firm* — Greenblum & Bernstein, P.L.C.

(57) ABSTRACT

A carton including multiple focused susceptors can be configured to provide multiple heating configurations for microwave heating of a packaged food product. In at least one heating configuration, the microwave susceptors are arranged such that food product has a softer texture when heated. In a second heating configuration, the microwave susceptors such that the food product has a crispier texture when heated. In use a consumer can select any of the multiple carton configurations for heating the food product.

15 Claims, 13 Drawing Sheets

(56) References Cited

U.S. PATENT DOCUMENTS

| | | | | |
|---|---|---|---|---|
| 5,416,305 | A | 5/1995 | Tambellini | |
| 5,565,228 | A | 10/1996 | Gics | |
| 5,630,960 | A | 5/1997 | Gomez | |
| 5,858,487 | A | 1/1999 | Boehler et al. | |
| 5,948,308 | A | 9/1999 | Wischusen, III | |
| 6,143,337 | A | 11/2000 | Fishman et al. | |
| 6,359,272 | B1 | 3/2002 | Sadek et al. | |
| 6,717,121 | B2 | 4/2004 | Zeng et al. | |
| 7,108,878 | B2 | 9/2006 | Tiffany et al. | |
| 8,106,339 | B2 | 1/2012 | Robbins et al. | |
| 2003/0230572 | A1 | 12/2003 | Kim | |
| 2004/0149746 | A1* | 8/2004 | Hoese et al. | 219/730 |
| 2004/0238534 | A1* | 12/2004 | Mast | 219/730 |
| 2005/0184066 | A1 | 8/2005 | Brooks et al. | |
| 2005/0205565 | A1 | 9/2005 | Cole et al. | |
| 2006/0188630 | A1 | 8/2006 | Rettey | |
| 2007/0087090 | A1 | 4/2007 | Russell et al. | |
| 2007/0221669 | A1 | 9/2007 | Ly | |
| 2008/0000897 | A1 | 1/2008 | Robbins et al. | |
| 2008/0078759 | A1 | 4/2008 | Wnek et al. | |
| 2008/0175959 | A1 | 7/2008 | Hill et al. | |
| 2010/0038359 | A1* | 2/2010 | Laubhan et al. | 219/730 |

FOREIGN PATENT DOCUMENTS

| | | |
|---|---|---|
| EP | 1 481 922 | 12/2004 |
| EP | 1 840 047 | 10/2007 |
| JP | 05-042503 | 2/1993 |
| JP | 6-500521 | 1/1994 |
| JP | 2005-350079 | 12/2005 |
| WO | WO92/03358 | 3/1992 |
| WO | WO94/16606 | 8/1994 |
| WO | WO01/30657 | 5/2001 |
| WO | WO2007/033183 | 3/2007 |
| WO | WO2007/123611 | 11/2007 |
| WO | WO 2007/141140 A2 | 12/2007 |
| WO | WO2008/91812 | 7/2008 |
| WO | WO2010/19758 | 2/2010 |

OTHER PUBLICATIONS

PCT Search Report and Written Opinion issued in counterpart PCT application No. PCT/US09/05253 (13 pages).

European Search Report issued in counterpart European application No. 09 814 913.1 dated Dec. 5, 2012 (10 pages).

Russian Office Action of counterpart Russian application No. 2011115835 with English translation (7 pages).

Chinese Office Action of counterpart Chinese application No. 200980146402X with English translation (13 pages).

Chinese Office Action issued Aug. 19, 2013 in counterpart application No. 200980146402.X with English language translation.

* cited by examiner

MICROWAVEABLE CARTON HAVING MULTIPLE FOCUSED SUSCEPTORS

CROSS-REFERENCE TO RELATED APPLICATION

This application claims priority to provisional U.S. Patent Application No. 61/136,644, filed Sep. 22, 2008, the entire content of which is incorporated herein by this reference thereto.

BACKGROUND

This specification generally concerns a microwaveable food package and methods of using that package to heat a comestible product. More particularly, this specification deals with a microwaveable container that can be configured to provide alternative heating techniques yielding alternate characteristics for the comestible product.

SUMMARY OF SELECTED ASPECTS OF THE INVENTION

A microwaveable carton according to this disclosure preferably is constructed and arranged so that the carton can be used in at least two configurations to heat and/or cook a food product packaged therein. Preferably, in at least one of the configurations, the carton includes a plurality of microwave susceptor surfaces operable to reflect microwave energy away from a cavity containing the food product, while also generating sufficient radiant heat to affect the heating and/or cooking of at least the top surface of the food product. In addition, at least one other susceptor surface has a diminished reflectivity so that a portion of the incident microwave energy is transmitted and is effective to heat and/or cook other portions of the food product.

Further, a method of heating a food product is disclosed in which one of a plurality of carton configurations is selected depending upon whether a softer textured product or a crispier textured product is desired.

BRIEF DESCRIPTION OF THE DRAWINGS

Many objects and advantages of this invention will be apparent to those skilled in the art when this description is read in conjunction with the appended drawings wherein like reference numerals have been applied to like elements and wherein.

DETAILED DESCRIPTION

Figure 1:
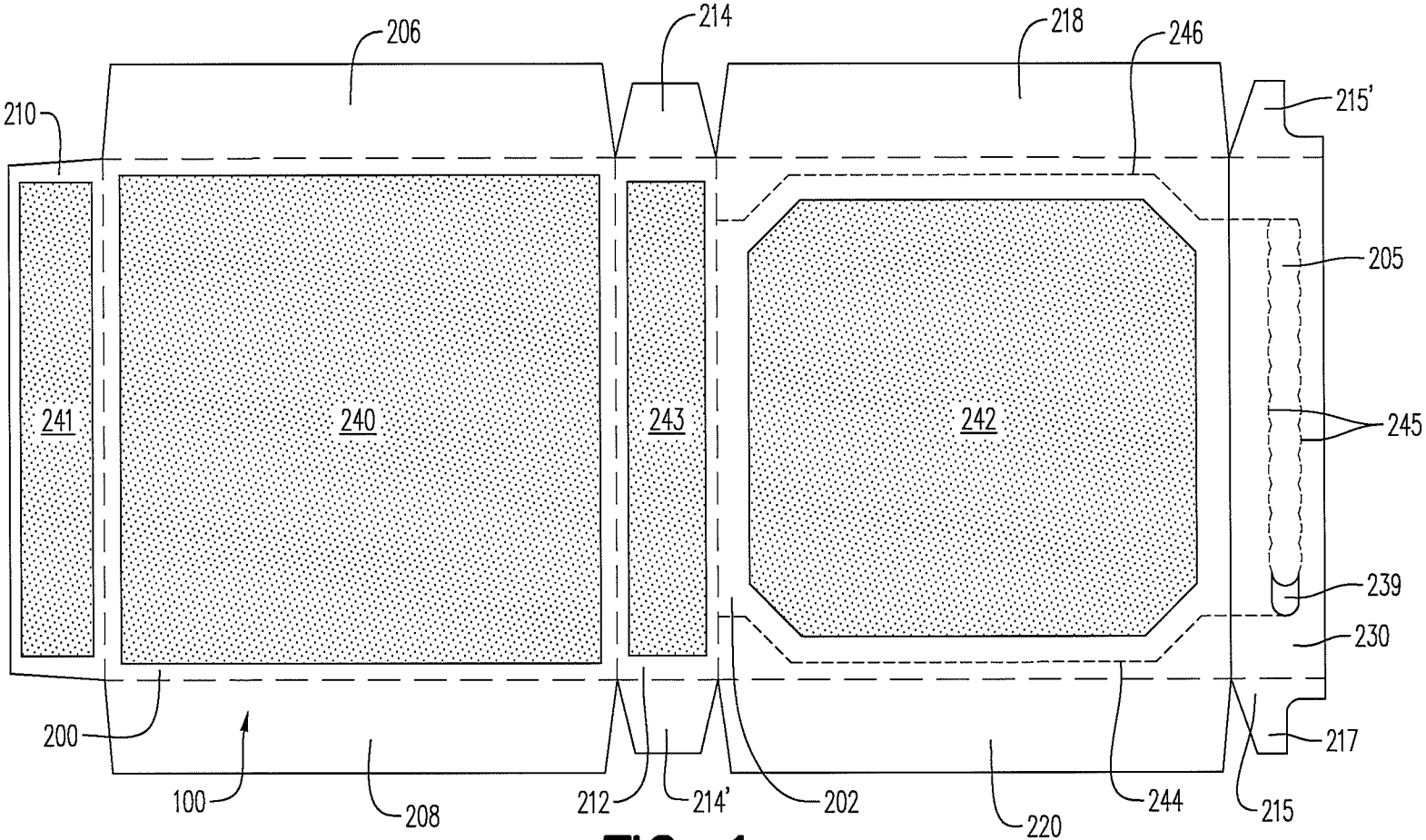
FIG. 1 is a plan view of a preferred embodiment of a blank.

As described herein, a microwaveable, food-packaging carton preferably includes a plurality of microwave susceptors. The microwave susceptors may be focused microwave susceptors. That carton is preferably formed or erected from a blank. When used to heat the comestible product in a microwave oven, the carton converts to a microwave heating tray that utilizes (i) microwave energy to directly heat a portion of the comestible product, (ii) radiant heat generated by susceptor materials energized by microwave energy, or (iii) a combination of microwave energy and radiant heat to quickly and uniformly heat a comestible product. Based on the cooking configuration, thermal transfer is accomplished through conduction, radiation, convection, and/or dielectric heating. The carton itself can be arranged in any of several different configurations to provide desired characteristics for the comestible product, which can be either softer or crispier texture in bread products. The carton can be used to provide more uniform heating of food products including breads and toppings. In an alternative embodiment, a carton can have a single cooking configuration.

In the preferred embodiment (see FIG. 1), the carton of this invention includes a blank 100. Preferably, a single sheet of material forms the blank 100. In the preferred embodiment, a single piece of paperboard forms the blank 100, which is substantially symmetrical about a longitudinally extending axis. The paperboard is selected from material having sufficient mechanical properties to form a carton that can hold one or more comestible products. The total weight of the comestible products may be as much as about 48 ounces, but may preferably be less, such as up to about 10 ounces, and more preferably up to about 8 ounces. Depending upon the particular comestible products, the total weight may be even less, e.g., up to about 7 ounces, up to about 6 ounces, up to about 5 ounces, up to about 4 ounces, up to about 3 ounces, up to about 2 ounces, or up to about 1 ounce. Moreover, the paperboard material is selected such that, when converted to a heating tray, the heating tray is capable of supporting a comestible product having the weight characteristics set forth above.

Preferably, the material used to form the blank 100 has a thickness in the range of about 14 to about 24 points (i.e., about 0.014 inches to about 0.024 inches) and preferably may be a thickness of about 18 points (i.e., 0.018 inch). The material may, for example, comprise solid bleached sulfate (SBS) paperboard. The paperboard can be any color. Nevertheless, the paperboard preferably may be white since white can readily be printed with product marketing indicia prior to formation into the final package. Desirably, the paperboard selected is safe for use with food products and safe for use in microwave ovens. The 18 point paperboard may have 48 gauge (0.00048 inch) metalized oriented polyester (OPET) adhesively laminated to one or more locations on its surface intended to face the interior of the carton. Furthermore, a food safe coating, such as a clay coating, may be provided on the outside surface (or non food contacting surface) to enhance printability. Preferably, any such coatings are microwave safe. At least a portion of the blank 100 may be coated and/or may be printed with designs, indicia, and/or product marketing indicia.

In other embodiments, the blank 100 may be formed from other microwaveable materials, such as heat resistant plastics, and the like when exposed to microwave energy and the resulting heating temperatures. Preferably, these alternative materials are also safe for use with foods.

In a preferred embodiment, the blank 100 includes two major surface portions 200, 202 which may be generally square or rectangular. The first major surface portion 200 eventually becomes the bottom of as assembled carton 300 (see FIG. 2) and the second major surface portion 202 (see FIG. 1) eventually becomes the top of the assembled carton 300 (see FIG. 2). These major surface portions are proportioned to accommodate a food product having predetermined width, length, and thickness dimensions. Generally, the dimensions of the major surface portions 200, 202 are selected to exceed those predetermined product dimensions by a spacing in the range of about 0.1 to about 0.5 inches, preferably in the range of about 0.2 to about 0.3 inches, so that the product does not touch the perimeter of the major surface portions 200, 202.

Integrally attached to two generally parallel side edges of the first major surface portion 200 are a pair of generally rectangular inner side panels 206, 208. Integrally attached to each of the other generally parallel side edges of the first major surface portion 200 are a generally rectangular inner front panel 210 and a generally rectangular back panel 212. Each end of the back panel 212 preferably includes a corresponding laterally extending tab 214, 214', which may be glued or otherwise affixed to a corresponding one of the adjacent inner side panels 206, 208 during carton assembly.

The second major surface portion 202 of the blank 100 is integrally connected along one side to the back panel 212 so that the two major surface portions 200, 202 are aligned with one another along the longitudinal axis of the blank 100. Integrally attached to two generally parallel sides of the second major surface portion 202 is a generally rectangular corresponding outer side panel 218, 220. Each outer side panel 218, 220 is generally longitudinally aligned with a corresponding one of the inner side panels 206, 208. Integrally attached to the remaining side of the second major surface portion 202 is an outer front panel 230. Each end of the outer front panel 230 includes a locking tab 215, 215' having a protrusion 217 designed to cooperate with a corresponding one of the inner side panels 206, 208 to form a corner of the carton when assembled. The outer front panel 230 includes 50% cut lines 245 and a pull tab end that form a detachable tear strip 205. A finger-access opening 239 is provided adjacent to the pull tab end of the tear strip 205. Suitable conventional scoring and creasing defines carton edges (shown as broken lines) in the blank 100 so that carton forming machinery can form an open tray and, after the tray is filled with a comestible food product, close and seal the top to make a finished package.

The surface of the blank 100 as seen in FIG. 1 forms the inner portions of an assembled carton. Conversely, the opposed surface of the blank (i.e., the surface under the blank as seen in FIG. 1) forms the outer portions of an assembled carton. The blank 100 preferably includes four microwave susceptor surfaces disposed on portions of the blank that form inner portions of the assembled carton. The first susceptor surface 240 is provided on the first major surface portion 200 of the blank 100. This susceptor surface 240 may be attached to the surface portion 200 adhesively or mechanically, and may be printed thereon or otherwise affixed thereto. Preferably the first susceptor surface conforms to the shape of perimeter of the first surface portion 200. As illustrated, the first susceptor may be generally square, having dimensions sufficient to substantially cover the first major surface portion 202 while leaving a small clearance between the perimeter of the first susceptor surface 240 and the perimeter of the first major surface portion 200. Preferably the clearance may be on the order of about 0.125 to about 0.5 inches. To properly heat the food product, the first susceptor surface 240 should preferably be sized to correspond to the predetermined width dimensions of the food product to be packaged and to be substantially coextensive with the first major surface portion 200. While a 0.125 inch clearance distance between the respective perimeters meets the condition of substantial coextensivity, distances greater than 0.125 inch can also be accommodated as long as the product to be heated will have substantial surface contact with the susceptor material.

The second susceptor surface 242 is provided on the second major surface 202 and may be attached to the surface portion 202 adhesively or mechanically, and may be printed thereon, or otherwise affixed thereto. The perimeter of the second susceptor surface 242 is configured and sized so that it can be slightly inside 50% cut lines 244, 246 which define the lines along which a major portion of the second major panel 204 can be separated so as to open the assembled carton. Again, the perimeter of the second susceptor surface may be spaced from those cut lines by a minimum distance lying in the range of about 0.125 to about 0.5 inches from those 50% cut lines 244, 246. In addition, the perimeter of the second susceptor surface may be spaced from the hinge line between the bank panel 212 and the second major portion 204. With such an arrangement, the second susceptor panel 242 provides substantial coextensivity with the removable portion of the second major surface 204. If desired the second susceptor panel 242 may be generally square or generally rectangular. Moreover, the second susceptor panel 242 may include chamfered corner regions so that its perimeter more closely approaches the extent of the removable portion of the surface 204.

The third susceptor surface 241 is preferably located to be on the inner front panel 210. This third susceptor surface 241 may be affixed to the front panel 210 in the manner described above with respect to the first and second susceptors. The third susceptor surface 241 may be generally rectangular with dimensions sufficient to substantially cover the inner front panel 210 such that the perimeter of the inner front panel 210 and the perimeter of the third susceptor surface are spaced from one another in the range of about 0.125 to about 0.375 inches.

The fourth susceptor surface 243 is preferably located on the back panel 212 and may be affixed to the back panel 212 in the manner described above in connection with the other susceptor panels. The fourth susceptor surface 243 may be generally rectangular with dimensions sufficient to substantially cover the back panel 212 while leaving a clearance in the range of about 0.125 to about 0.375 inches between the perimeter of the back panel 212 and the perimeter of the fourth susceptor surface 243.

For the preferred embodiment, four susceptor surfaces are used. However, additional susceptor surfaces may be provided in the carton. The total susceptor surface area should be selected such that the susceptors do not generate so much heat inside the carton when heated in a microwave oven that glue and other adhesives (used to form the carton) melt or otherwise degrade such that the carton loses structural integrity, falls apart, and/or cannot withstand heating. This can be accomplished by selecting high temperature adhesives for the carton or by adjusting the susceptor properties (area, optical density, patterning, and the like) or by a combination of both.

In other embodiments, first susceptor surfaces 242 may have chamfered corners or may be formed in a variety of shapes including, but not limited to, circular, rectangular, oval, and the like. Preferably, the shape of the principal susceptor surfaces 240, 242 is chosen to conform to the principal dimensions of the food product to be heated.

Each susceptor surface 240, 241, 242, 243 can be formed of any suitable microwave-active material including metallic substances, such as aluminum, or non-metallic, ink-based materials. For example, the susceptor surfaces can be formed of a polyester film metalized with aluminum. If used, ink-based susceptor materials can be printed directly onto the paperboard, thus providing a simple, quick, and easy method of forming susceptor surfaces without the need for align, register, an affix laminate susceptor materials. In other embodiments, the susceptor surface described herein can be included in the carton as a loose, separate piece of susceptor card stock that can be placed into position prior to heating.

Preferably, the susceptors used herein have an optical density lying in the range of about 0.20 to about 0.28. For some applications, the optical density may be about 0.215. Optical density can also be used to characterized susceptor materials. The optical density (absorbance) is a measure of the amount of incident electromagnetic energy that transfers through a partially absorbing substance, such as a metalized film, and can be measured in absorbance units (AU), which are logarithmic units in AU used to measure optical density. If T is the percentage of electromagnetic energy transmitted, then the absorbance is calculated from the expression $$AU=-\log 100\ T$$

An increase in absorbance of 1.0 AU corresponds to a reduction in transmittance by a factor of 10. If the absorbance is 1.0 AU then 10% of the electromagnetic energy is transmitted, while at 2.0 AU, only 1% of electromagnetic energy is transmitted.

The absorbance is a function of the susceptor material as well as its thickness and its pattern. Accordingly, a predetermined absorbance can be attained by suitable combinations of material, thickness, and pattern. Thus, each of the susceptors used in this structure can be made to have the predetermined absorbance characteristic needed for a particular food heating method.

In the preferred embodiment, the susceptors can be supported on a substrate formed of a 48 gauge biaxially oriented polyester metalized with aluminum (MPET), which is then laminated to 18 point solid bleached sulfate paperboard.

Not wishing to be bound by theory, it is believed that increasing the optical density to about 0.26 to about 0.27 will result in optimum bread characteristics because the microwave power ratio changes to approximately 10% transmission, 45% absorption and 45% reflection.

Figure 14:
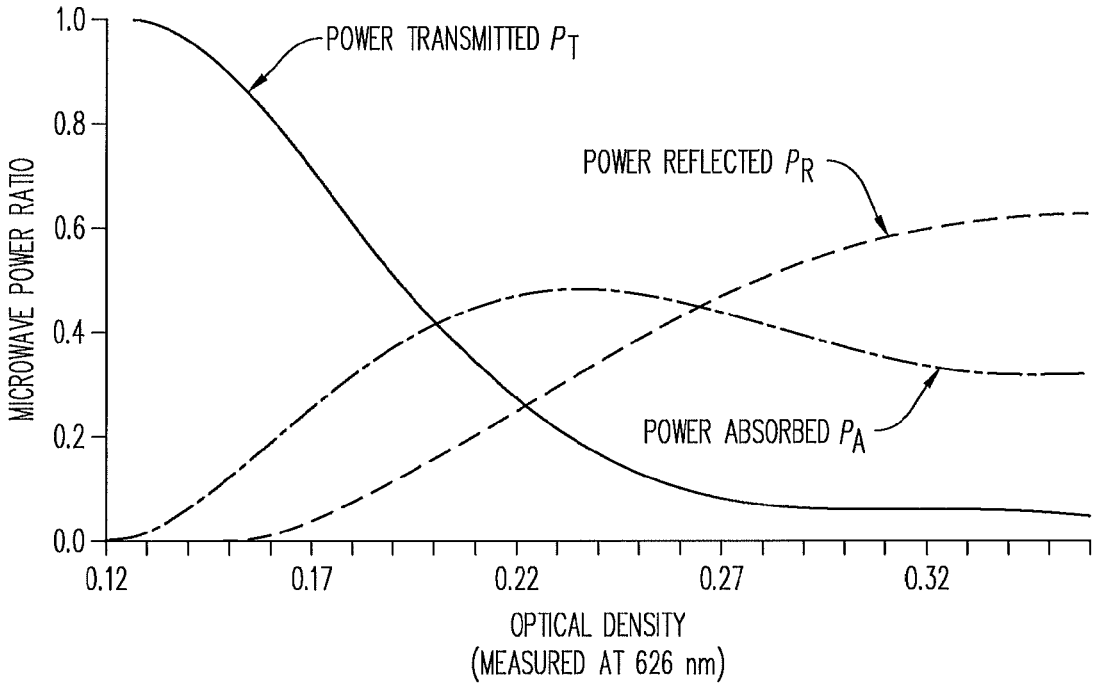
FIG. 14 graphically demonstrates the reflected, transmitted, and absorbed microwave power ratio as a function of optical density of susceptors.

The resistance, absorption and transmittance can be adjusted by altering the optical density, adjusting the patterning of the susceptor material, and/or by layering the susceptor material. For example, as shown in FIG. 14, the optical density measured at 626 nm can be chosen based on the preferred reflection, transmission, and absorbance microwave power ratio. Preferably, the optical density of the susceptor material is chosen so as to have the highest absorbed microwave power ratio.

In the preferred embodiment, the first susceptor surface 240 may be patterned to provide less than full strength heating. Susceptor patterning on all surfaces is dependent on the balance of dough and/or bread based product versus toppings and/or fillings in the food product to be microwave heated, and the intended crisping or browning on the bread. Decreasing the percentage of susceptor on the top and sides of the container will increase the microwave transmission into the various layers of the food product being heated. Not wishing to be bound by theory, it is believed that decreasing the percentage of susceptor on the top and sides of the container may have a negative impact on the quality of bread-based frozen products heated in the microwave.

For example, the susceptors can be 5% to 100% patterned on all surfaces. The second, third and fourth susceptors 241, 242, 243 located on the top and sides of the container are 100% patterned, while the first susceptor 240 is about 40% to about 60% patterned. For example, in a preferred embodiment, the first susceptor surface is 20% patterned to about 100% patterned, more preferably about 25% patterned to about 55% patterned. Also in a preferred embodiment, the second susceptor surface 242 is formed of a substantially continuous susceptor to provide higher heating temperatures. However, in other embodiments, the second susceptor surface 242 may be patterned. The third and fourth susceptor surfaces 241, 243 may be substantially continuous, as in the preferred embodiment, or patterned to reduce the strength thereof. The patterning of the susceptors may be varied depending on the strength needed to quickly and uniformly heat the type of food product contained within the carton. In addition, the patterning of the susceptors can be chosen to adjust the heating strength, which in turn may affect the final texture of the food product. The susceptors 241, 242, 243 may have the same or different patterns.

The susceptors for the second, third and fourth panels 241, 242, 243 are most favorable to the microwave performance of the bread when they have about 100% coverage of the associated surface. This arrangement maximizes reflection and absorption of microwave energy into the non-contact susceptor surfaces. This arrangement will also increase the heating of the product through radiant heat and decrease product exposure to microwaves. The susceptor pattern on the first panel 240 can be varied from 0% to 100% coverage depending on the amount of browning and crisping desired on the bottom surface of the product.

To assemble the package, the inner side panels 206, 208, the inner front panel 210, and the back panel 212 are folded relative to the first major surface 200 so that the first susceptor 240 is located at the bottom of the partially assembled carton. The tabs 214, 214' are attached to a corresponding interior surface of the corresponding inner side panel 206, 208 so that a self-supporting tray is formed with an integral lid. A food product, that has been enclosed and sealed in an external package, is then deposited in the partially assembled carton. The external package for the food product may, for example, comprise a clear food-grade film material. The dimensions of the food product and the carton blank have been selected such that the food product is received in the partially assembled carton so that dimensions of the food product are substantially coextensive with the first susceptor 240, and are spaced from the back panel 212 and the susceptor surface 243. With the dimensions of the food product and the carton thus being coordinated, the food product has a predetermined weight. The food product may be frozen prior to placement in the partially assembled carton. Alternatively, the food product may be frozen after the formation, filling, and sealing of the carton is completed.

Figure 2:
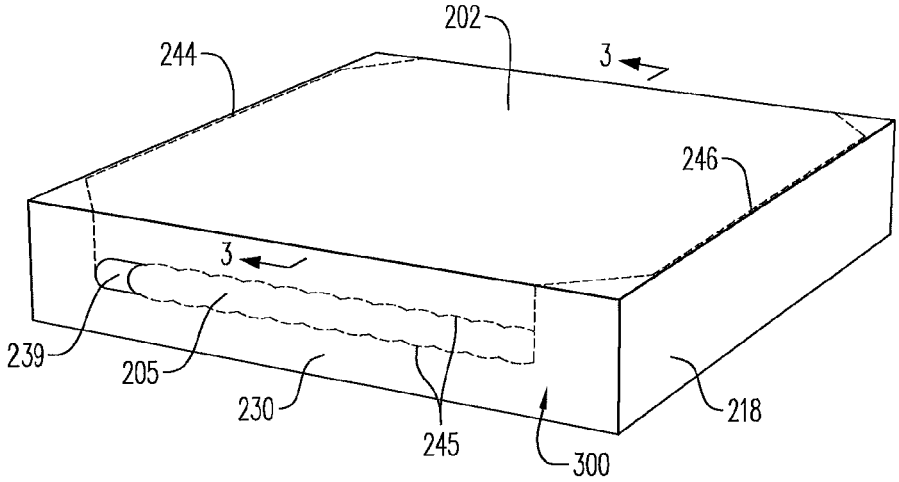
FIG. 2 is a perspective view of a carton having multiple panels with focused susceptors formed from the blank of FIG. 1 after assembly.

The filled, partially assembled package is subsequently closed and sealed. In particular, the second major surface 202 is folded along the fold line defined between the second major surface 204 and the rear panel 212 so that the second major surface 202 is positioned overlying the tray portion of the package. Thereafter, the outer side panels 218, 220 folded into overlying relationship with the corresponding inner side panels 206, 208 and are sealed and/or attached thereto. Either before or after the side panels for folded and/or sealed, the inner front panel 210 is folded upwardly along the crease line defined between the inner front panel 210 and the first panel portion 200. The outer front panel 230 is folded downwardly along the crease line defined between the outer front panel 230 and the second panel portion 202 so that the outer front panel 230 overlies the inner front panel portion 210. The tabs 215, 215' are then sealed and/or affixed to corresponding outer side panels 218, 220. If desired, the lower edge portion of the outer front panel 230 may secured to the adjacent bottom portion of the inner front panel 210. Suitable conventional food-safe glues can be used to attach the various surfaces to one another, as set forth above. The completely assembled package is illustrated in FIG. 2.

The major dimensions of the blank 100 (see FIG. 1) are also selected such that the assembled heating tray 300 (see FIG. 2) is sized and configured to fit in a conventional microwave oven. In addition, the package depth is selected such that the package will stand on its side on a typical freezer shelf in an upright freezer case of a store selling groceries and food items. Also, the package proportions must be sufficient that the package can be easily formed, filled, and sealed using mechanical carton-forming equipment. Based upon these considerations and those set forth above, typical dimensions of the carton 300 may range from about 5.00 inches square to about 10.0 inches square and about 1.0 inch high to about 3.0 inch high. In the preferred embodiment, the carton 300 may be about 7.25 inches square and about 1.375 inches high.

The particular food product for which the carton described above can be used is not intended to be limited. In this connection the food product may comprise flatbreads (such as pita bread, crepe, tortilla, focaccia, piadina, naan, chapati, lavash, roti, pancake, blintz, lafa, aish mehahra, barbari bread, bazlama, bhakri, bhatura, bing, flammkuchen bread, flatkaka, injera, laobing, laxoox, lefse, luchi, malooga, markook, ngome, papadum, paratha, pide, rieska, sangak, tunnbrod, yufka, galette), panini bread (which could consist of French bread, sourdough bread, ciabatta, or other related forms of leavened or unleavened bread), biscuits, English muffins, muffins, crumpets, scones, shortcake, waffles, pastries, croissants, pizza, ealzones, stromboli, garlic bread, bagels, baguettes, hamburger rolls, hot dog rolls, breadsticks, Brioche, French toast, pocket sandwiches (fillings encased in a bread/dough), quiche and other pastry or pie crusts. Moreover, any of those food products may also be provided with a topping. Thus, the food product may include (a) an open-pored, light, bread-like portion and (b) a denser topping or cover layer containing other edible components. Ordinarily, the width and length of the carton cavity exceed the nominal predetermined dimensions of the food product to accommodate variations in the nominal dimensions that occur during production and so that the food product is fully supported by one of the major surfaces 200, 202. Typically, the food product is about 1 inch to about 1.25 inches thick. Typically, the bread product can include toppings, such that the bread to topping ratio is about 40/60. Preferably, the food product is fully and/or partially cooked so that the food product is only partially cooked and/or heated using the carton 300 described herein. In a preferred embodiment, the food product is fully cooked and is heated using the carton 300.

It should be noted that the completed carton 300 preferably includes 50% cut lines 244', 246' extending from the 50% cut lines 245 on the outer front panel 230 at the ends of the pull tab 238. The 50% cut lines 244', 246' also extend along (but are spaced from) peripheral side edges of the second major surface 202 between the second major surface 202 and the corresponding side panels 218, 220 (not visible), such that a generally triangular gusset is defined at each corner of the carton 300 on the top surface 202 of the carton 300. Moreover, in the preferred embodiment, the 50% cut lines 244', 246' on the inside of the second major surface 202 may be laterally offset from the 50% cut lines 244, 246 (see FIG. 1) on the outside of the second major surface 202. That offset allows deep, substantially continuous cut lines to be used on both sides of the second major surface 202 while maintaining a seal for the product. During opening, the paperboard fails between the offset cut lines to leave thinner, flexible edges on the top 202.

Figure 3:
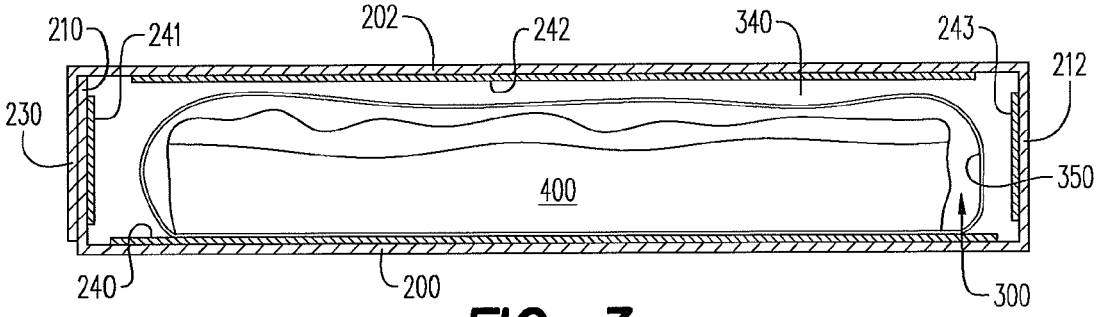
FIG. 3 is an enlarged cross-sectional view of the assembled carton taken along line 3-3 of FIG. 2.

A cross-sectional view of the assembled carton 300 containing a food product 400 is shown in FIG. 3. In the preferred embodiment, the food product 400 is wrapped in an external wrapper 350 such as a suitable food-grade plastic or shrink-wrap. The wrapped food product 400 is positioned in the assembled carton 300 such that the food product 400 rests substantially on the first susceptor surface 240, which is affixed to or printed on the first major panel 200. The back panel 212 integrally connects the first major panel 200 with the second major panel 202. A fourth susceptor surface 243 is affixed to or printed on the bank panel 212. The second major panel 202 lies substantially parallel to the first major panel 200. The second susceptor surface 242 is affixed to or printed on the second major panel 202. The inner front panel 210, which is integrally connected to the first major panel 200, is folded upwardly, while the outer front panel 230 is folded downwardly and affixed to the inner front panel 210 to seal the carton 300 as described above. The third susceptor surface 241 is affixed to or printed on the inner front panel 210.

In the preferred embodiment, when assembled, the second major surface 202 and susceptor surface 242, back panel 212 and fourth susceptor surface 243, and inner front panel 210 and third susceptor surface 241 of the carton 300 are spaced from and do not contact the food. Preferably, a "non-contact" space substantially surrounds the sides and top of the food product 400 so as to leave an empty peripheral space 340 between the food product 400 and the panels 202, 212, 210.

As used herein, the terms "non-contact" and "non-contact spacing" refer to the distance between the top and side panels of the carton and the food product contained therein. In the preferred embodiment, the food product is about 1 inch to about 1.25 inches thick. The food product thickness tolerance is about 0.125 inch to about 0.25 inch. The carton has an interior height of about 1.75 inches. Thus, the "non-contact spacing" can lie in the range from about 0.10 inch to about 0.75 inch, or more preferably in the range of about 0.125 inch to about 0.625 inch, and most preferably in the range of 0.125 inch to about 0.375 inch. This "non-contact" spacing is important when the food product is heated within the carton with the top closed. If the non-contact spacing is too small, the food product may be overheated and may burn. If the non-contact spacing is too large, the heating energy may be diminished and the food product will not be uniformly heated.

In the preferred embodiment, the non-contact susceptor surface temperatures range from about 370° F. to about 420° F. after about 40 seconds of heat time, while the temperature range of a susceptor in contact with the product depends upon the product temperature, contact area and mass of the food product.

Figure 4:
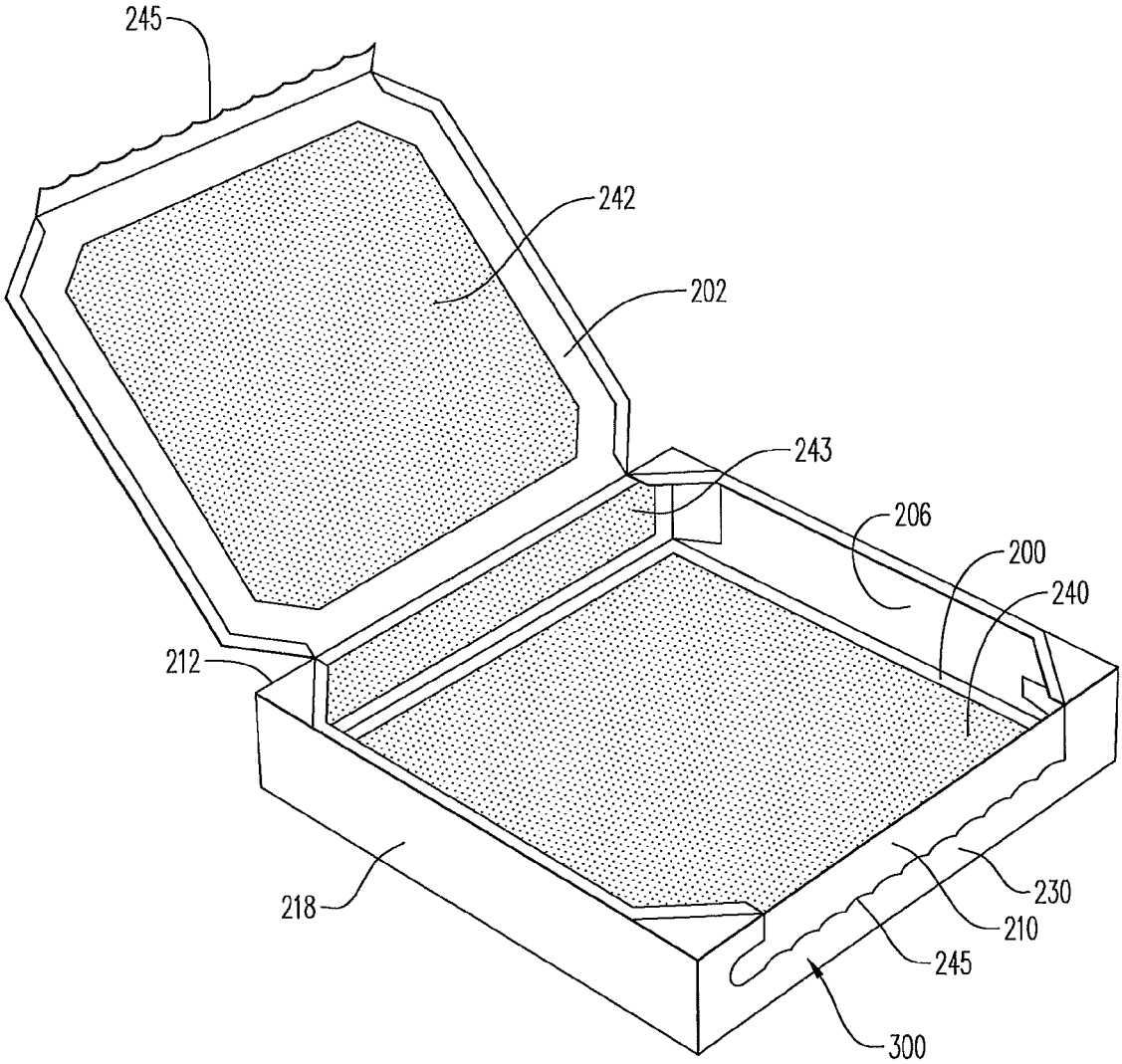
FIG. 4 is a perspective view of the carton of FIG. 2 with an open top.

The second susceptor surface 242 (see FIG. 4) may be a substantially solid, substantially continuous susceptor. However, for some food products, the second susceptor surface 242 may be patterned. While the top 202 is integrally attached to the first major panel 200 by the back panel 212 in the blank (see FIG. 1), when the package is opened in preparation for heating, the top 202 is removable along the fold line between the top 202 and the back panel 212. The back panel 212 includes the fourth susceptor surface 242 arranged to be generally perpendicular to the first susceptor surface 240. Preferably, the fourth susceptor 242 faces the internal cavity formed by the carton 300 and is fashioned as a substantially solid, continuous susceptor surface. However, depending on the heating requirements for the packaged food product, the fourth susceptor surface 242 may be patterned.

Figure 10:
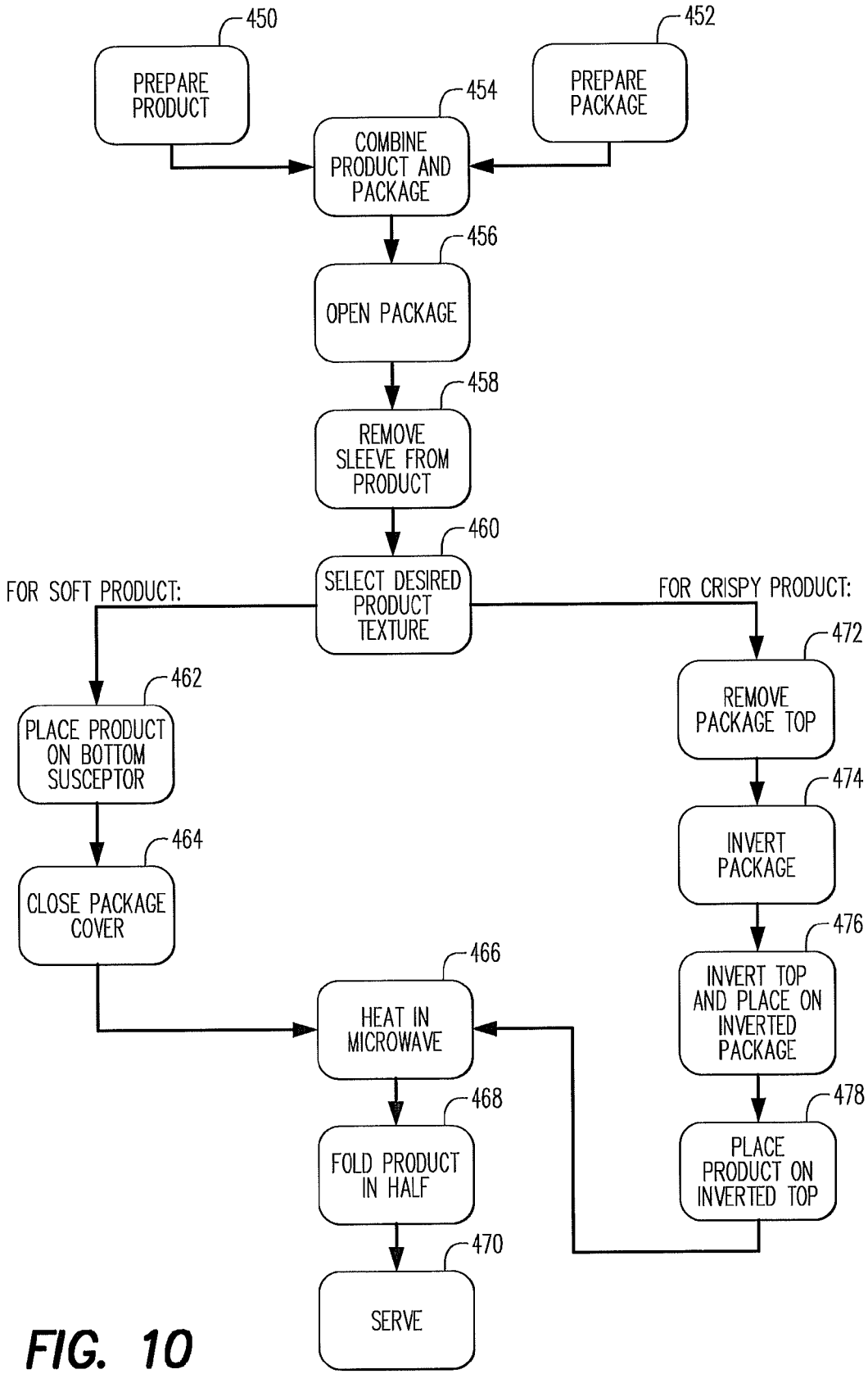
FIG. 10 illustrates process steps for packaging a food product and subsequent microwave heating of the food product using the carton of FIG. 2.

The first step in using a carton of the type described above involves packaging the food product 450 (see FIG. 10) to be packaged and distributed Using the blank 200 (see FIG. 1), the carton is partially assembled or prepared 452, as described above. Thereafter, the food product is combined 454 with the partially assembled carton, by depositing the food product therein. At that point, the final steps in the forming and sealing of the carton, described above, are completed and the finished package is obtained. As also described above, the food product may be frozen before placement in the carton, or after the combination with the carton. That filled carton or package then enters a commercial distribution network for distribution throughout the marketing region.

After distribution and purchase, a consumer ultimately decides to prepare the food item for consumption. As a first step in consumption, the consumer opens 456 the package. The opening step is accomplished by grasping the end of the pull tab 238 (see FIG. 2) and pulling to remove the tear strip 205 from the outer front panel 230 along the cut lines 245. With the tear strip 205 removed, the upper portion of the front panel 230 is lifted, tearing the central portion of the top 202 away from the remainder of the carton along the weakened 50% cut lines 244, 246 thereby lifting the top 202 of the carton 300 away from the sides 206, 208, 218, 220 along 50% cut lines 244, 244', 246, 246' to expose the food product 400.

Figure 5:
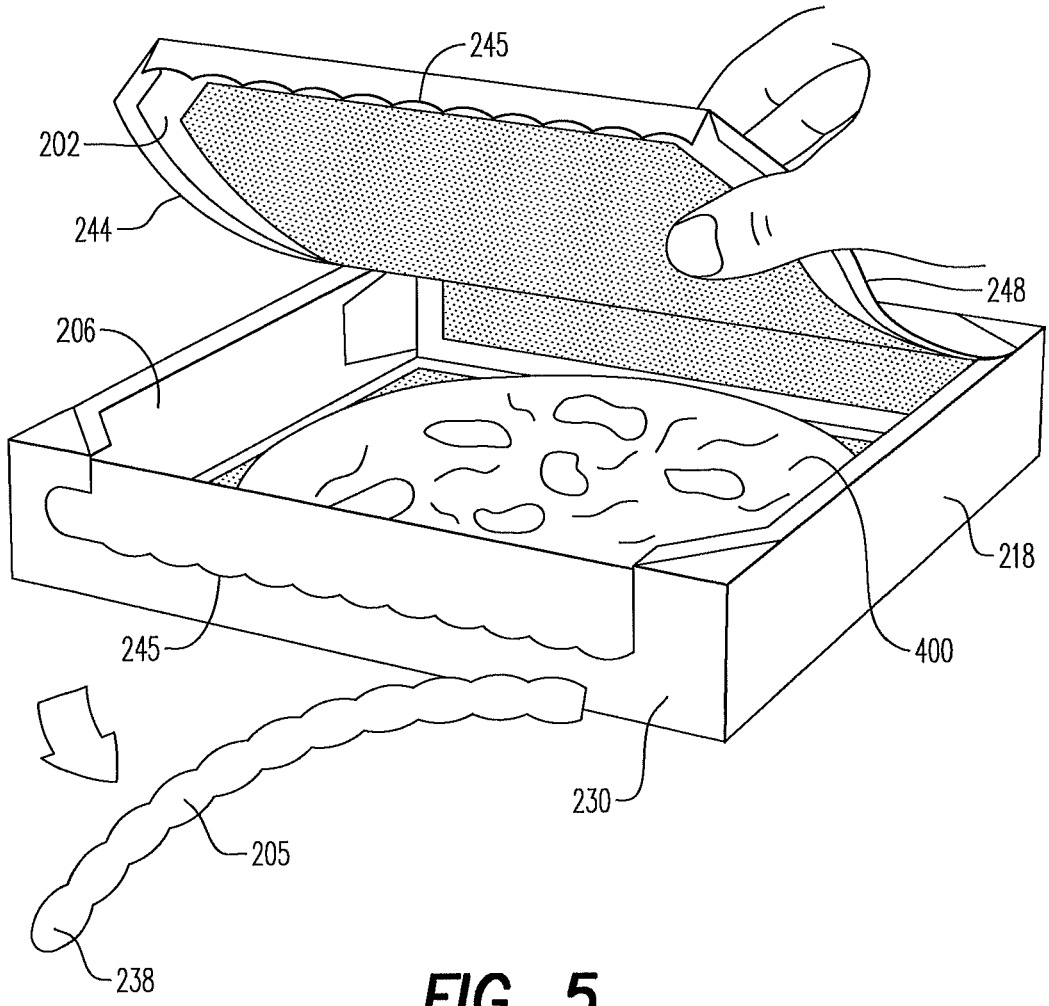
FIG. 5 is a perspective view of the carton of FIG. 2 containing a food product and being opened.

With the lid 202 opened (see FIG. 4), the consumer removes the food product 400 from the carton 300 (see FIG. 5). Next (see FIG. 10), the consumer removes 458 the external wrapper or sleeve 350 from the food product 400. That wrapper can be removed by cutting the wrapper open, by tearing the wrapper, or by separating portions of the wrapper along a seam. The particular removal step is dictated by the particular characteristics and design of the wrapper used. It is also within the scope of this disclosure to provide a food product that does not have a separate wrapper. Such an arrangement might be used in situations where the carton provides adequate shelf life for the product distributed with the carton.

Figure 7:
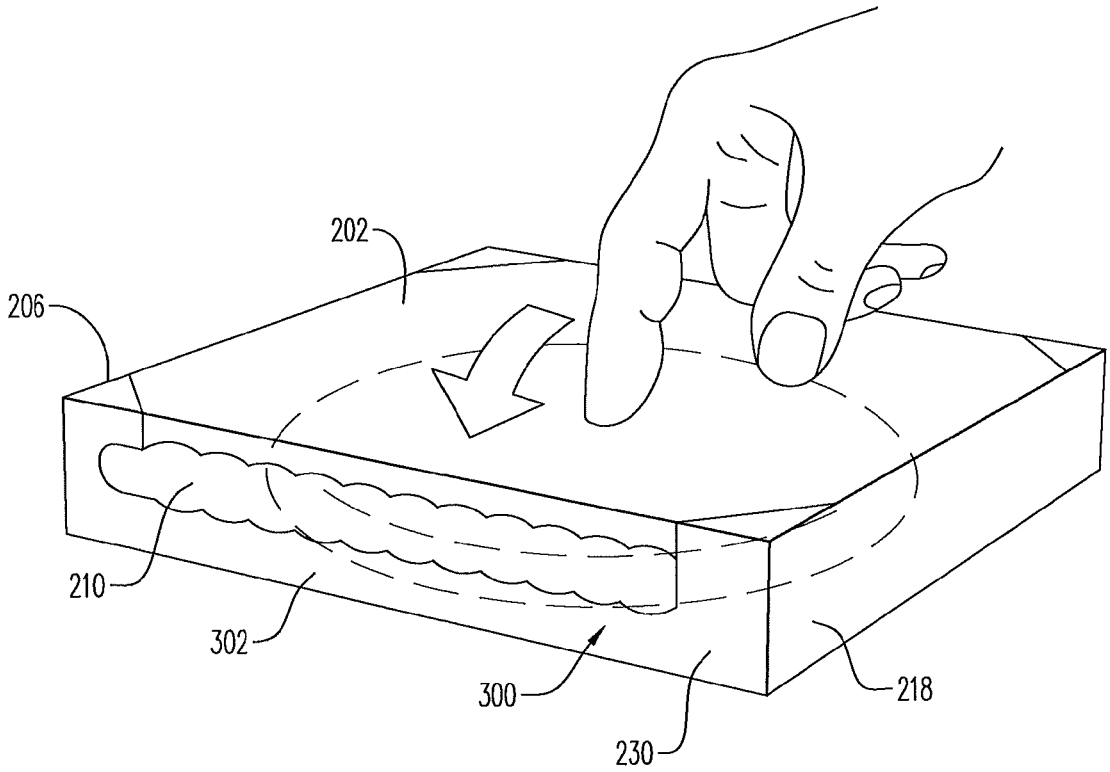
FIG. 7 is a perspective view of the carton of FIG. 2 having the top panel replaced, containing a food product, and being used in a first heating method.

Once the food product has thus been prepared, the consumer selects 460 (see FIG. 10) the desired texture for the food product after it has been heated. With carton having the structural features recited above, the consumer can at least select between a product having a soft texture or a product having a crispy texture. To effect the soft textured product, the consumer places the food product 462 (see FIG. 10) on the first susceptor surface 240 (see FIG. 4) on the bottom of the open carton 300. The food product is positioned so that it is spaced generally uniformly away from the susceptor surfaces on the front and rear panels of the carton 300. Then, the consumer closes 464 (see FIG. 10) the top 202 over the food product (see FIG. 7) by pushing the top 202 downwardly. In the closed position, the top 202 rests on edges of the side panels 206, 208, 218, 220 and edges of the front panel 302 formed by the overlapping inner front panel 210 and outer front panel 230 of the blank 100 (see FIG. 1). Once the carton 300 is closed, the "non-contact" spacing 340 prevents the susceptors 241, 242, 243 from contacting the food product 400 during microwave heating.

The "non-contact" spacing removes the food product from contact with the front and rear susceptor surfaces so that conductive heat transfer is avoided with those susceptor surfaces. In addition, by using a substantially continuous susceptor surface at the front and rear panels of the carton, those susceptor panels function as a shield against microwave radiation through the corresponding surfaces thereby reducing the intensity of microwave energy transmitted to the food product therethrough. Shielding is effected since the susceptors on the non-contact panels act to both reflect microwave energy away from the interior of the package and the food product therein as well as to absorb microwave energy incident on those surfaces. The microwave susceptor on the inside of the top 202 is also preferably substantially continuous and operates in the same manner as the front and rear susceptors to reflect portions of the incident microwave energy and/or absorb portions of that incident microwave energy. Nevertheless, the susceptor surfaces do not transmit significant portions of the incident microwave energy.

Due to the absorption of microwave energy by the top, front and rear susceptors, those susceptors become very hot in the presence of the microwave radiation. Preferably, those susceptors are designed so as to attain a temperature in the range of about 250° F. to less than about 450° F. The upper limit of the temperature range is selected so that the temperature attained is less than the kindling temperature of the paperboard used for the container. In that way, the hot susceptor surfaces will not cause the carton material to burn or become scorched. As a result, of the high temperature attained by the susceptor surfaces, the susceptor surfaces transfer heat by radiation to the food product inside the carton. The non-contact spacing between those susceptors of the food product is selected such that the heat energy transmitted by radiation to the food product is substantial, more particularly the energy transmitted by radiation to the food product exceeds the heat generated by microwave energy, and the heat generated by radiation by the susceptor surfaces may be as high as about 90% of the heat generated by the susceptor surfaces in the presence of microwave energy. Thus, the food product is heated by the radiant heat given off by the non-contact susceptor surfaces. Heating with radiant heat provides an important effect on the surface of the food product, particularly where the food product has a coating—more uniform heating of the topping is effected without hot-spots that are typical of heating only with microwave energy. Moreover, the heat applied from the front, rear, and top susceptors can be applied without substantial microwave interaction.

As discussed above, the bottom susceptor 240 (see FIG. 4) preferably is patterned so as to have different microwave transmission characteristics than the other susceptors. More specifically, the bottom susceptor 240 allows transmission of a predetermined amount of incident microwave radiation—for example a portion lying in the range of about 20% to about 80% of the incident microwave energy, and more preferably about 50% of that incident energy. The remaining portion of the incident microwave radiation is reflected outwardly by the bottom susceptor 240 and some energy may function to heat the bottom susceptor. Again, the susceptor is selected and designed so that its temperature lies in the range of about 250° F. to about 450° F.

Of course, microwave energy does access the cavity within the carton through the side panels without significant obstruction or degradation. Nevertheless, the different characteristics of the susceptor panels permit microwave heating throughout the body of the food product at the same time that the topping is selectively heated by radiant heating from the top susceptor.

Preferably, the use of radiant heating to heat the food products results in better texture as compared to food products that are heated in a microwave using a single susceptor. In addition, the use of both top and side non-contact susceptors accelerates heating of the top surface of the food product while heating the base of the food product more slowly. This arrangement provides more even and more focused heating of the topping, while increasing the overall heating time necessary to thoroughly heat the bread portion of the food product. In addition, the base exposure to transmitted microwaves is also reduced resulting in a product in which the bread portion is not chewy.

For example, when heating a microwave pizza, the heating of the toppings can be accelerated while the bread portion of the pizza is heated more slowly. The increased water activity in the toppings of the pizza acts to absorb microwave energy thereby providing additional protection of the bread from transmitted microwaves. By adding a susceptor to the top of the container, the water contained in toppings of the food product are more quickly transitioned from solid to liquid state. Because the bread is heated by microwave energy—albeit at a substantially reduced energy level, the bread is heated throughout at a level that allow the bread portion to be heated in the same amount of heating time required for the radiant heating to heat the topping portion. As a result, there is substantially no change in the physical, internal structure of the bread and the bread maintains a soft texture.

Not wishing to be bound by theory, it is believed that in use the heat transfer by radiation drops off about 0.1% to about 10% through the non-contact distances set forth above. In addition, because the carton 300 is closed when heating in the first configuration, the food product is heated in a moisture-rich environment with the benefits of convective heat currents reducing total water loss and further shortening product heat time.

Besides the heating aspects noted above, the first susceptor surface 240 contacts the bottom of the food product during heating. In the preferred embodiment, the first susceptor surface 240 is less than full strength and functions to moderately crisp and/or bake the bottom of the food product without degrading its texture.

After the food product has been heated in the microwave oven 468 (see FIG. 10), the top of the container 300 can be opened and the heated product can be removed. For products such as flat breads and the like, the heated food product can be folded approximately in half 468 and served 470.

Figure 8:
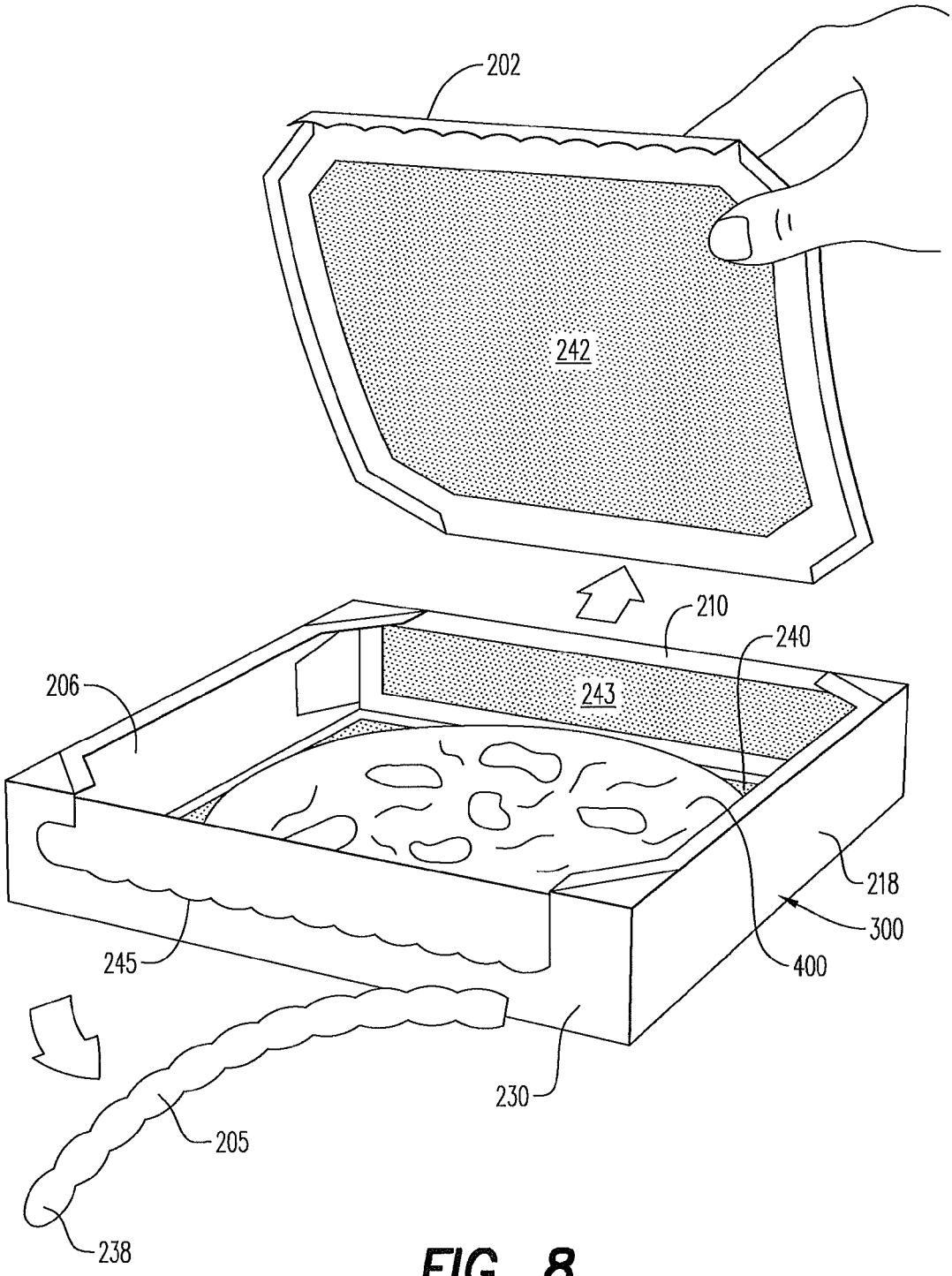
FIG. 8 is a perspective view of the carton of FIG. 2 having the top panel removed, containing a food product, and being used in a second heating method.

When the consumer selects the crispy product heating configuration for the package, (see FIG. 10), the consumer first pulls and removes the pull tab 238 (see FIG. 8) of the carton 300. As described above, the consumer then lifts the upper portion of the outer front panel 230 and lifts the top 202, thus opening the lid portion 202 of the top panel 230 along the cut lines (50% cute lines) 245 to expose the food product 400.

Figure 6:
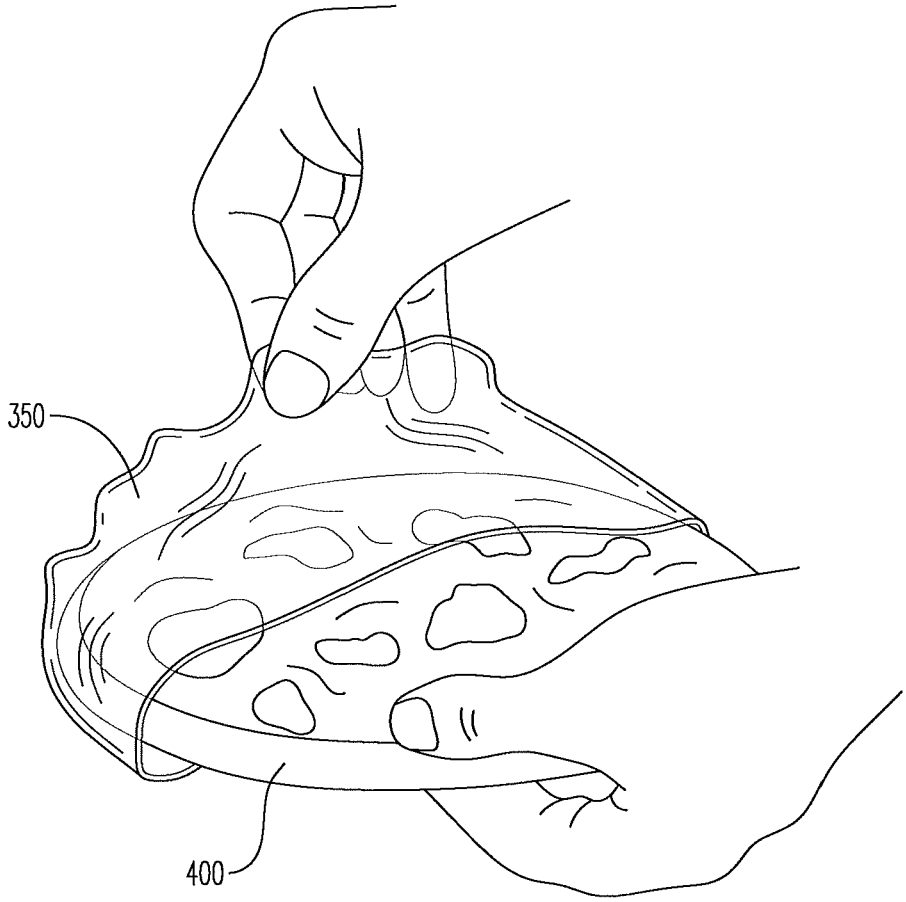
FIG. 6 is a pictorial view of the food product of FIG. 5 being removed from an external wrapper.
Figure 9:
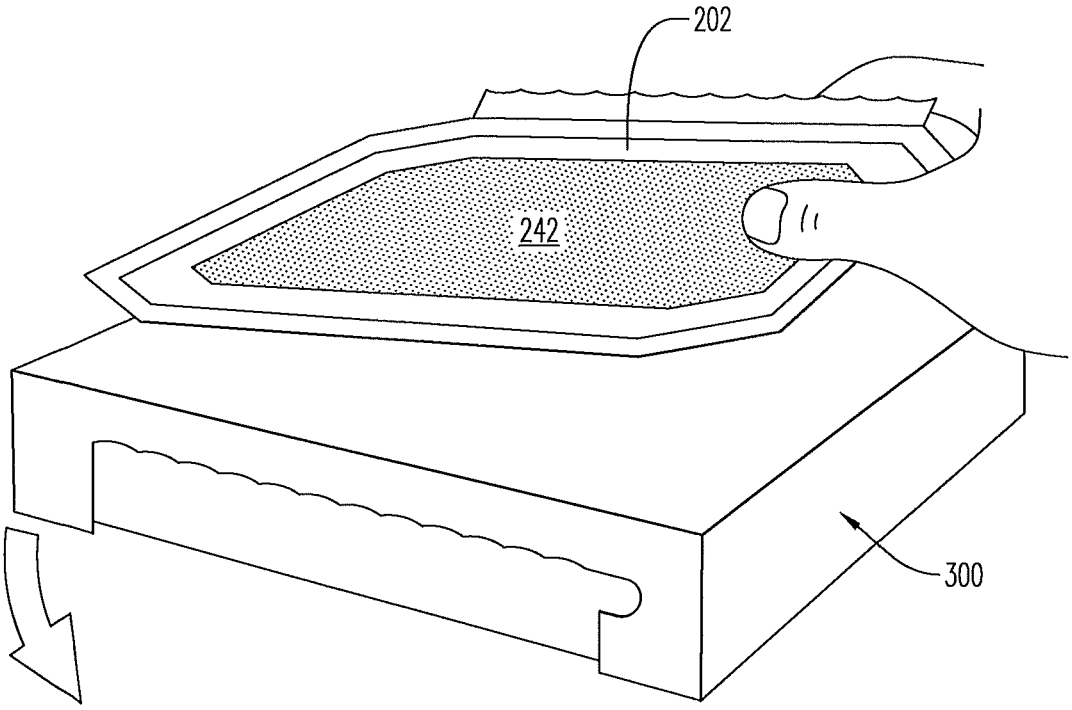
FIG. 9 is a perspective view of the carton of FIG. 2 having the top panel supported by the remaining portion of the carton, and being used in a third heating method.

Once the food product has been exposed, the consumer can remove the food product 400 from the carton 300 (see FIG. 6) to remove the protective wrapper 350 from around the food product 400. Then, the consumer separates or removes 472 (see FIG. 10) the top 202 (see FIG. 8) of the carton 300 from the back panel 210 along the perforation line therebetween. The carton 300 (without the food product) is then inverted 476 (see FIG. 10) so that the cavity opens downwardly (see FIG. 9). Next, the top 202 is inverted so that the susceptor 242 is on top and faces upwardly. Then, the top 202 is placed on the inverted carton 300 placed on the carton 300 (see FIG. 9) with the second susceptor surface 242 facing upwardly. Next 478 (see FIG. 10), the consumer places the food product on the exposed inverted susceptor 242, and places the assembly of carton 300, the lid 202, and the food product in a microwave oven for heating.

Preferably, after being subjected to microwave heating, the second heating configuration for the carton yields a heated food product having a crispy texture with a tender inner crumb. More particularly, during heating, the bottom of the food product receives heat by conduction from the underlying susceptor 242 originally position on the inside of the top of the carton. Moreover, the susceptor 242 rests in a back-to-back arrangement resulting with the susceptor 240 originally located in the bottom of the carton. Because the top 202 is a planar surface, heat is normally lost to both sides. But, by placing the bottom 200 and the first susceptor surface 240 in a back-to-back relationship with the top 202 and second susceptor surface 242, the susceptor 240 both reduces heat loss from the susceptor 242 away from the food product and improves the thermal energy available to the food product by conduction during the heating operation. Given that the second susceptor 242 has a continuous configuration, while the first susceptor 240 has a patterned configuration, the second susceptor 242 provides a hotter surface for crisping the bottom of the food product. As a result, a food product cooked or heated with this second carton configuration has a crispier texture than a food product cooked or heated by the first carton configuration.

When using the crispy heat method, first and second susceptors 240, 242 are back to back and can reach a combined temperature of about 425° F. A container having a single susceptor typically reaches a temperature of about 355° F., while a container without any susceptors typically reaches a temperature of only about 200° F. Not wishing to be bound by theory, it is believed that the higher temperatures reached by the containers described herein provide more desirable heating for bread products and gives a crispy texture to the outside of such products. The container as designed minimizes overheating of toppings due to the reflection of microwave energy from the second susceptor, while simulating pizza-oven-like heating of the crust. When the same food products are heated in microwave containers lacking second, third and fourth susceptors, the toppings tend to be overheated while the underlying bread product is properly heated. When heated in microwave containers lacking any susceptors, the toppings are also overheated, while the lower bottom surface is heated resulting in a tough crust.

Furthermore, when a food product is heated in the microwave oven 466 with this second carton configuration, the top, sides, and full thickness of the food product are exposed to microwave energy in the oven, and are not shielded from that energy, except through the bottom surface. Interaction of that microwave energy with the bread portion of the food product increases the chewiness of the food product being heated in comparison to a food product heated with a carton in the first configuration discussed above. After heating, the food product can be folded 468 as described above (see FIG. 10), and then served 470.

When using the soft heat method, the final temperature of the crust has been measured at about 178° F. after heating on high in a 1200 W microwave for about 2 minutes and 30 seconds. The food product being heated is a flatbread product including about 33.51% plain flatbread, 14.76% sauce, 20.58% vegetable blend, 21.16% protein and about 9.99% cheese. The ratio of bread to toppings preferably is about 1:2, for example about 34:66. The flatbread may be a leavened, pressed, par-baked, pocketless pita style bread that is about 0.24 to about 0.30 inch thick. When the same flatbread product is heated using the crisp heat method, the final temperature of the crust was measured at about 187° F. The increase in topping temperature was about 15° F.

For both the soft and crispy heat methods, the specified susceptor optical density is about 0.215 (measured at a wavelength of 626 mm). For such susceptor material, 20% of the microwave energy is reflected, 45% is absorbed, and 35% is transmitted to the product. Therefore, the susceptor, as designed, for the non-contact surfaces of the package reduces transmission of microwave energy by about 65%. The effective area of the package having this reduction in transmission is about 51.625 inches or about 64% of the package internal surface area not including the bottom crisping portion. Despite this reduction of microwave transmission, the topping and crust final temperatures with and without the top and side susceptors are substantially the same.

Ideally, the container is designed so that the toppings and bread reach about 165° F. simultaneously. However, for optimum bread performance, the bread can be brought to about 165° after the toppings.

Other configurations of the carton 300 can be used in additional heating and heating methods. For example, the top can be completely removed prior to heating. In such a configuration, the food product would be heated principally by microwave energy, with a reduced heating of the bottom surface because the bottom susceptor 240 is patterned and has a reduced heating capacity and the shielding provided by the top susceptor 242 is not available. In another configuration, the top of the carton can be removed, rotated by an angle of about 45° and placed at an angle over the top edge of the side, back and front panels of the carton. In this configuration, moisture released during heating of the food product is released from the carton cavity and allowed to vent into the microwave oven.

Generally, the texture of a food product heated in one of the heating configurations disclosed herein is improved as compared to the texture of foods heated using a single microwave susceptor surface, and other microwave carton configurations. The texture of food products heated with the carton disclosed herein may be measured and evaluated for comparison using a standard food texture analyzer, such as the TA.XTPlus or the TA.XT2i Texture Analyzer, available from Texture Technologies Corp of Westchester County, New York. Such texture analyzers can utilize different functions and/or attachments, such as a variety of probes, to quantify the crunchiness, crispness, brittleness, hardness, swelling, firmness, adhesiveness, tack, tackiness, resilience, springiness, cohesiveness, fracturability, shelf life, and many other characteristics of food products.

For example, to study microwave heated flatbread, the flatbread can be heated in either the first heating configuration (non-contact method) or the second heating configuration (contact method). Susceptor material is placed inside the package in both contact and non-contact methods to convert microwave energy to radiant and conductive heat to ensure the flatbread texture is preserved and any toppings it may contain are heated evenly and thoroughly.

For testing purposes, cartons made of the same material are first constructed. Some of the cartons should be constructed as described herein, while other cartons should include a single, standard susceptor on the bottom surface as in conventional microwave heating trays. Identical flatbreads with no toppings may then placed in each carton and heated for 1 minute. The flatbreads are then allowed to cool for 1 minute after heating. The cartons and the flatbread can then be removed from the microwave, sliced into four equal sections having a width of about 1.5 inches at the widest point. The slices can then be evaluated for texture using one of the texture analyzers described in detail above. The results should indicate that the texture of the flatbread is preserved after heating when heated in the carton described herein, as contrasted to flatbread heated in standard cartons having no susceptors or cartons having a single susceptor. After heating, the flatbreads heated in the different heating methods can have the same or different temperatures. However, the flatbread heated in the cartons described herein should prove to be crispier when heated in the second configuration or softer when heated in the first configuration, when compared to flatbreads heated in standard, single susceptor cartons or cartons having no susceptors.

The food products heated using the first container configuration and radiant heating have a soft texture when compared to foods heated using a single microwave susceptor and tested using a texture analyzer. Food products heated using the second container configuration have a crispier texture with a tender inner crumb as measured by the texture analyzer than food products heated using a single microwave susceptor or no susceptors.

In a first test, the difference in toughness of a flatbread product heated in the containers described herein (test) and using the crispy heat method as compared to flatbread products heated in conventional microwave heating trays having no susceptors (control) is determined. The flatbread product used for all tests conducted herein include about 33.51% plain flatbread, 14.76% sauce, 20.58% vegetable blend, 21.16% protein and about 9.99% cheese. The ratio of bread to toppings is about 1:2. The flatbread is a leavened, pressed, par baked, pocketless pita style bread that is about 0.24 to about 0.30 inch thick.

First, a control flatbread is prepared using a standard microwave box and a test flatbread is prepared in a test container as described herein and having a patterned aluminum susceptor. Each sample is placed pre-grilled side face down in the package. Each sample is microwave heated for about 45 seconds at 100% power in a 1200 W microwave oven and allowed to stand for about 2 minutes after heating. Each sample is then removed from the container and quickly cut into strips of about 1⅛ inch to about 1¼ inch in width by about 3 inches to about 3⅛ inches in length using a knife and cutting board. The sample strips are carefully yet quickly mounted onto the lower and upper tines of a pizza rig, with care being taken not to tear or bend the sample.

The pizza rig used herein is a Pizza Tensile Rig (A/PT) using a 5 kg load cell that is mounted on a TA-XT2 Plus (TA) Texture Technologies Incorporated. Once the samples are loaded, the TA-XT2 Plus is activated. A second strip from the same Flatbread is run immediately afterward. Preferably, the TA-XT2 Plus has the following settings during testing: Mode: Measure Force in Tension; Option: Return to start; Pre-Test speed: N/A; Test speed: 5.0 mm/s; Post-Test speed: 10.0 mm/s; Distance: 45 mm; Time: 60 sec; Trigger Type: Button; and Data Acquisition Rate: 400 pps. A macro is written to determine the Maximum force (g), the force area (g.sec) and the gradient (g/sec) of the resulting plots from the TA-XT2 Plus run.

10 tests were done for each of the test group and the control group. For a few of the Flatbreads heated, a third strip was cut to ascertain whether the sample was becoming significantly tougher after more elapsed time following heating. The max force and force area values were used to evaluate sample "toughness" and compare the samples heated in the test box and those heated in the control box.

The outliers were identified using Grubb's test for statistical outliers, and is based on the assumption of normality. The Grubb's test calculates a P value only for the value furthest from the rest. Table 1 shows the critical values for Grubb's test. If Z is greater than the tabulated value, then P is less than 0.05.

TABLE 1

| N | Critical Z 5% |
|---|---|
| 3 | 1.15 |
| 4 | 1.48 |
| 5 | 1.71 |
| 6 | 1.89 |
| 7 | 2.02 |
| 8 | 2.13 |
| 9 | 2.21 |
| 10 | 2.29 |
| 11 | 2.34 |
| 12 | 2.41 |
| 13 | 2.46 |
| 14 | 2.51 |
| 15 | 2.55 |
| 16 | 2.59 |
| 17 | 2.62 |
| 18 | 2.65 |
| 19 | 2.68 |
| 20 | 2.71 |
| 21 | 2.73 |
| 22 | 2.76 |
| 23 | 2.78 |
| 24 | 2.80 |
| 25 | 2.82 |
| 26 | 2.84 |
| 27 | 2.86 |
| 28 | 2.88 |
| 29 | 2.89 |
| 30 | 2.91 |
| 31 | 2.92 |
| 32 | 2.94 |
| 33 | 2.95 |
| 34 | 2.97 |
| 35 | 2.98 |
| 36 | 2.99 |
| 37 | 3.00 |
| 38 | 3.01 |
| 39 | 3.03 |
| 40 | 3.04 |
| 50 | 3.13 |
| 60 | 3.20 |
| 70 | 3.26 |
| 80 | 3.31 |
| 90 | 3.35 |
| 100 | 3.38 |
| 110 | 3.42 |
| 120 | 3.44 |
| 130 | 3.47 |
| 140 | 3.49 |

After discarding outliers (only one was identified), the following number of data points, shown in Table 2, remain to be tested.

TABLE 2

| Heat prep and measured value | N |
|---|---|
| Control Maximum Force (g) | 22 |
| Test Maximum Force (g) | 22 |
| Control Force Area (g · sec) | 22 |
| Test Force Area (g · sec) | 23 |

The maximum force test results for the control and test groups are shown in Table 3.

TABLE 3

| | N | MEAN | STD.DEV | % COV | MIN | MAX | MEDIAN | SKEWNESS |
|---|---|---|---|---|---|---|---|---|
| Control Group | 22 | 971 | 354 | 36.5 | 444 | 1579 | 903.5 | 0.07 |
| Test Group | 22 | 408 | 57 | 13.9 | 351 | 567 | 396.2 | 1.28 |

Figure 11:
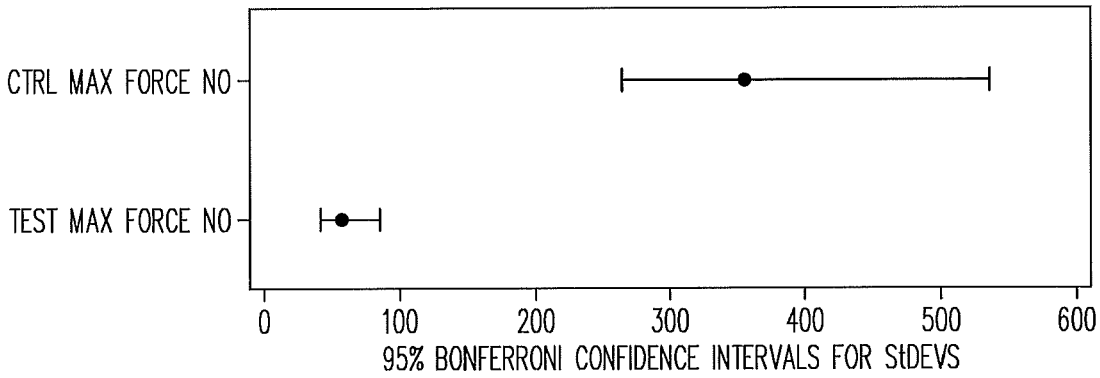
FIG. 11 is a graph comparing toughness of crisp heated product to prior art.

The normality testing showed that the test group's maximum force test results did not follow a normal distribution as shown in FIG. 11.

Since susceptor maximum force results did not follow a normal distribution, the Levene test was used to determine whether there was equal variance for the two maximum force results. The Levene test is an inferential statistic used to assess the equality of variance in different samples. The p-value of 0.000 assures that the variances are unequal. Results of Levene's test are also shown in FIG. 11.

As shown in Table 4, the means for maximum force of the samples heated in the control box are different from the maximum force in grams (g) of samples heated in the test box at 95% confidence. Table 4 includes the results of a 2 sample t-test with unequal variances.

TABLE 4

| | N | Mean | Std Dev | SE Mean |
|---|---|---|---|---|
| Control Max Force | 22 | 971 | 354 | 75 |
| Test Max Force | 22 | 408.7 | 56.6 | 12 |

Difference = μ (Control Max force NO) − μ (Test max force NO)
Estimate for difference: 562.223
95% CI for difference: (403.736, 720.709)
T-Test of difference = 0 (vs not =): T-Value = 7.36, DF = 22
P-Value = 0.000

The force-area results are shown in Table 5.

TABLE 5

| | N | MEAN | STD.DEV | % COVARIANCE | MIN | MAX | MEDIAN | SKEWNESS |
|---|---|---|---|---|---|---|---|---|
| Control | 22 | 1385 | 637 | 46.0 | 383 | 2578 | 1251 | 0.38 |
| Test | 23 | 723 | 206 | 28.6 | 423 | 1215 | 719 | 0.60 |

Figure 12:
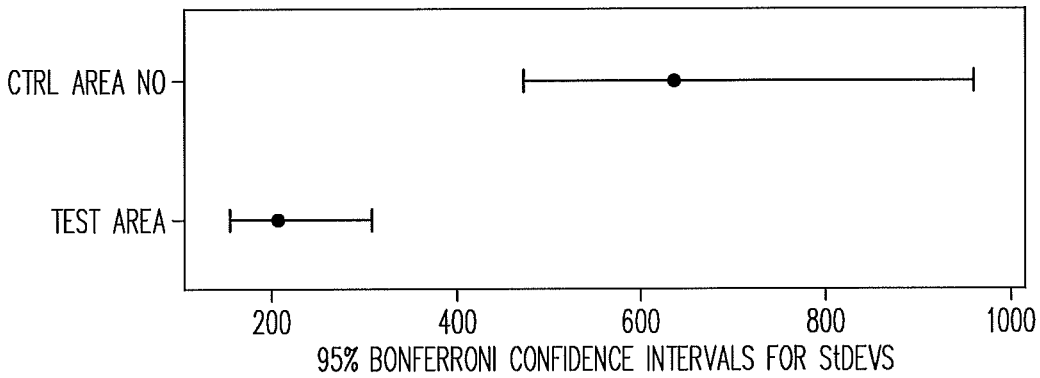
FIG. 12 is a graph comparing toughness per unit area of crisp heated products to prior art.

As shown in Table 5 and FIG. 12, both the control and test group results had a normal distribution.

The force test was used to determine whether there was equal variance for the two force-area results in grams per second (g/sec) and the results are shown in Table 6 below. The p-value of 0.000 assures that the variances are unequal.

TABLE 6

| | N | Mean | Std Dev | SE Mean |
|---|---|---|---|---|
| Control Force Area | 22 | 1385 | 637 | 136 |
| Test Force Area | 23 | 723 | 206 | 43 |

Difference = μ (Ctrl Area NO) − μ (Test Force Area No)
Estimate for difference: 661.996
95% CI for difference: (368.416, 955.575)
T-Test of difference = 0 (vs not =): T-Value = 4.64, DF = 25
P-Value = 0.000

As shown in the data, for the samples tested, two separate parameters from the texture analysis representing toughness of the sample are shown to be statistically different when comparing measurements of samples heated in the control box versus the test box. Thus, the containers described herein function to provide different textures to food products heated using the containers described herein as compared to conventional microwave containers.

In a second test for analyzing the texture of flatbreads heated using the containers described herein, identical flatbreads were heated in both the soft heat method and the crispy heat method. The property of "crispness" is then examined by statistical analysis of gradients (average slope of force plot in g/sec) obtained from the TA runs and potential differences between the heat preps will be determined.

A first sample is heated for about 2 minutes and thirty seconds using the soft heat method, while a second sample is heated for about 2 minutes and forty-five seconds using the crispy heat method. The samples were both heated in a 1200 W microwave oven. Following microwaving, the samples are allowed to sit in the microwave for an additional 1 minute. The toppings are then scraped off and the samples are placed top-down on a cutting board. Two replicate measurements are made on opposing sides of the sample.

During testing, the texture analyzer the following settings: Mode: Measure Force in Compression, Pre-Test speed: 1.0 mm/s, Test speed: 1.0 mm/s, Post-Test speed: 10.0 mm, Distance: 5.0 mm, Trigger Type: Auto-5 grams, and Data Acquisition Rate: 400 pps.

The Grubb's test for outliers, as described above, was applied to the data sets for both the soft and crispy heat methods. One data point was excluded from the "soft" set as it was determined to be a statistical outlier. Table 7 shows the data points obtained for 29 soft samples and 30 crisp samples. The data shown is measured in grams per second (g/sec).

TABLE 7

| | "Soft" | "Crisp" |
|---|---|---|
| Count | 29 | 30 |
| Mean | 285.7 | 414.7 |
| Median | 258.6 | 402.6 |
| % COV | 36.38 | 39.92 |
| Minimum | 99.3 | 126.9 |
| Maximum | 479.4 | 795.7 |

Normality tests were then applied to both the soft data sets and the crispy data sets. Normality tests are used to determine whether data follows a normal distribution. Normality tests can further compute how likely an underlying random variable is to be normally distributed.

Both data sets were found to have a normal distribution ($p>0.5$). The data sets were then tested for equal variance, and the results are shown in Table 8. As shown, the data exhibits 95% Bonferroni confidence intervals for standard deviations, the F-test showed normal distribution, the test statistic was 0.39, and the P-value was 0.016.

TABLE 8

| | N | Lower | Std Dev | Upper |
|---|---|---|---|---|
| Soft Gradient (no outliers) | 29 | 79.9 | 103.9 | 147.3 |
| Crisp Gradient | 30 | 127.8 | 165.6 | 232.9 |

Next, a two sample T-test assuming unequal variances was run and the results are shown in Table 9.

TABLE 9

| | N | Mean | Std Dev | S.E. Mean |
|---|---|---|---|---|
| Soft Gradient (no outliers) | 29 | 285.7 | 104 | 19 |
| Crisp Gradient | 30 | 414.7 | 166 | 30 |

Figure 13:
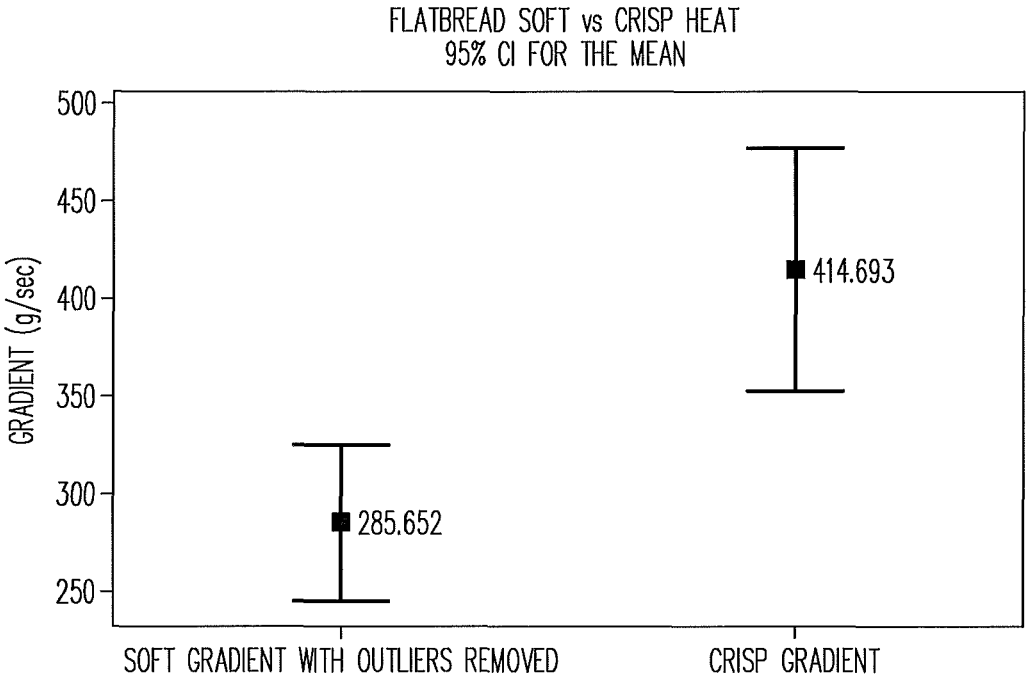
FIG. 13 graphically demonstrates the statistical analysis of differences between the two heating methods.

Difference = μ (Soft Gradient outlier removed) − μ (Crisp Gradient)
Estimate for difference: −129.038
95% CI for difference: (−201.105, −56.971)
T-Test of difference = 0 (vs. not =): T-Value = −3.60
P-Value = 0.001; DF = 49
Means are unequal at 95% confidence As shown in FIG. 13, the property of "crispness" was measured by statistical analysis of gradients (average slope of force plot in g/sec) obtained from the texture analyzer runs. The higher the gradient, the "crispier" the samples. FIG. 13 shows the 95% Confidence limits for the means (whiskers), as well as the mean values themselves (squares and displayed number) for the gradients of the two heating methods. These values were obtained from 29 measurements of the shorter "soft" heating method and 30 measurements of the longer "crispy" heating method.

As shown, the gradients obtained from the texture analyzer runs, which are analogous to the crispness of the samples, are visually and statistically different at 95% confidence. The samples heated in the microwave in the platform susceptor carton configuration for 2 minutes and 45 seconds are crispier than those heated in the microwave enclosed in the susceptor carton for 2 minutes and 30 seconds.

Figure 15:
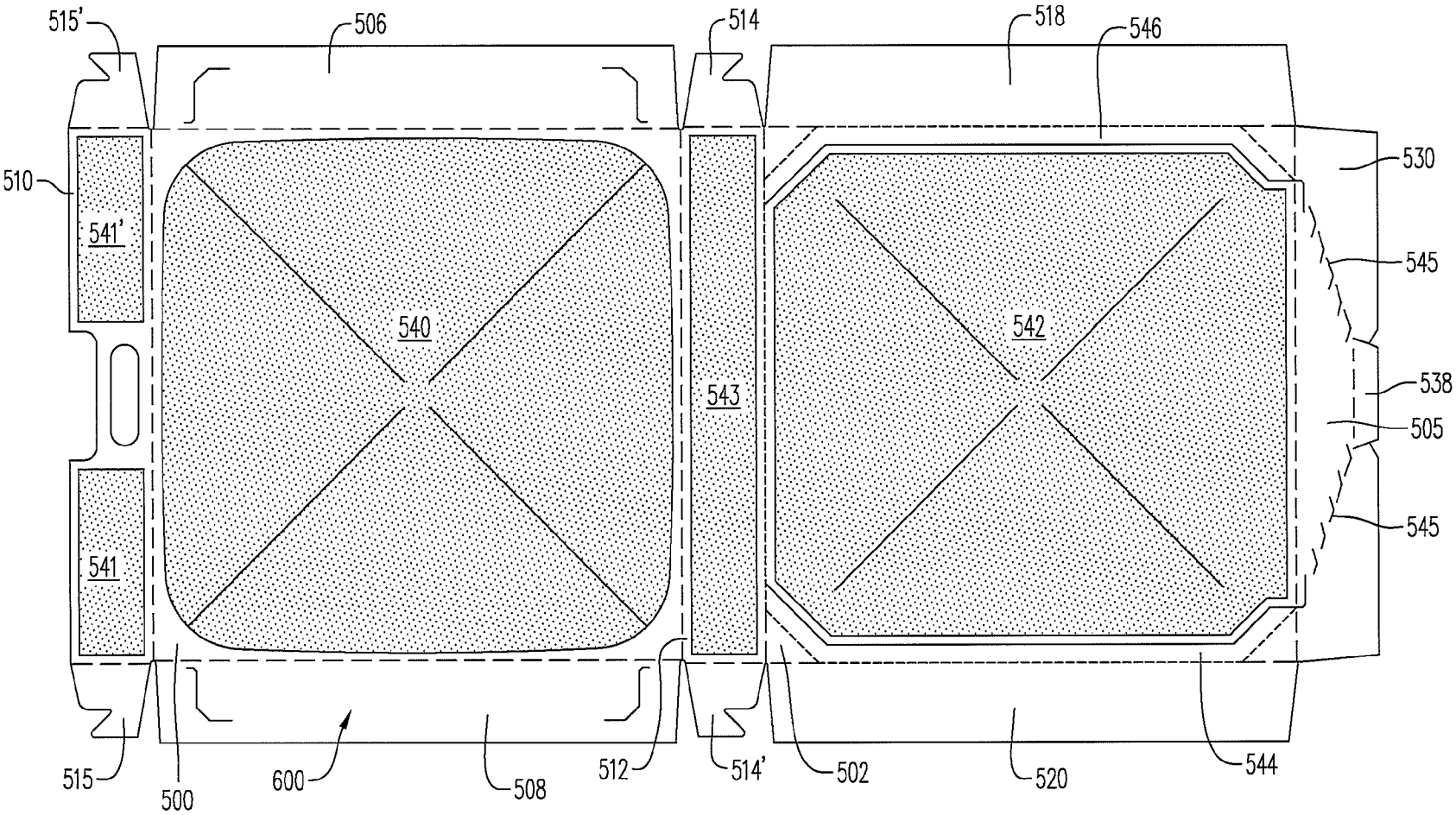
FIG. 15 is a plan view of an alternative embodiment of a blank.

In alternative embodiments, the carton can be a top load carton formed of a blank 600 as substantially shown in FIG. 15. Preferably, a single sheet of material forms the blank 600. The material can be paperboard as described above. In the preferred embodiment, the blank 600 includes two major surface portions 500, 502. The first major surface portion 500 eventually becomes the bottom of an assembled carton and the second major surface portion 502 eventually becomes the top of the assembled carton. Integrally attached to two generally parallel side edges of the first major surface portion 500 are a pair of generally rectangular inner side panels 506, 508. Integrally attached to each of the other generally parallel side edges of the first major surface portion 500 are a generally rectangular inner front panel 510 and a generally rectangular back panel 512. Each end of the back panel 512 preferably includes a corresponding laterally extending tab 514, 514', which may be glued or otherwise affixed to a corresponding one of the adjacent inner side panels 506, 508 during carton assembly. Each end of the front panel 210 also includes a corresponding laterally extending tab 515, 515', which may be glued or otherwise affixed to a corresponding one of the adjacent inner side panels 506, 508 during carton assembly. The laterally extending tabs 514, 514', 515, 515' can include protrusions designed to cooperate with a corresponding one of the inner side panels 506, 508 to form a corner of the carton when assembled.

The second major surface portion 502 of the blank 600 is integrally connected along one side to the back panel 512 so that the two major surface portions 500, 502 are aligned with one another along the longitudinal axis of the blank 600. Integrally attached to two generally parallel sides of the second major surface portion 502 is a generally rectangular corresponding outer side panel 518, 520. Each outer side panel 518, 520 is generally longitudinally aligned with a corresponding one of the inner side panels 506, 508. Integrally attached to the remaining side of the second major surface portion 502 is an outer front panel 530. The outer front panel 530 includes cut lines 545 and a pull tab end 538 that form a tear zone 505 that can be pulled to lift and separate the top second major surface portion 502 from the remainder of the carton after assembly.

Preferably, the blank 600 includes five microwave susceptor surfaces disposed on portions of the blank that form inner portion of the assembled carton. The first susceptor surface 540 is provided on the first major surface portion 500 of the blank 600. This susceptor surface 540 may be attached to the surface portion 500 adhesively or mechanically, and may be printed thereon or otherwise affixed thereto. Preferably the first susceptor surface conforms to the shape of perimeter of the first surface portion 500. As illustrated, the first susceptor may be generally square, having dimensions sufficient to substantially cover the first major surface portion 502 while leaving a small clearance between the perimeter of the first susceptor surface 540 and the perimeter of the first major surface portion 500. Preferably the clearance may be on the order of about 0.125 to about 0.5 inches. To properly heat the food product, the first susceptor surface 540 should preferably be sized to correspond to the predetermined width dimensions of the food product to be packaged and to be substantially coextensive with the first major surface portion 500. While a 0.125 inch clearance distance between the respective perimeters meets the condition of substantial coextensivity, distances greater than 0.125 inch can also be accommodated as long as the product to be heated will have substantial surface contact with the susceptor material.

The second susceptor surface 542 is provided on the second major surface 502 and may be attached to the surface portion 502 adhesively or mechanically, and may be printed thereon, or otherwise affixed thereto. The perimeter of the second susceptor surface 542 is configured and sized so that it can be slightly inside 50% cut lines 544, 546 which define the lines along which a major portion of the second major panel 504 can be separated so as to open the assembled carton. Again, the perimeter of the second susceptor surface may be spaced from those cut lines by a minimum distance lying in the range of about 0.125 to about 0.5 inches from those 50% cut lines 544, 546. In addition, the perimeter of the second susceptor surface may be spaced from the hinge line between the bank panel 512 and the second major portion 504. With such an arrangement, the second susceptor panel 542 provides substantial coextensivity with the removable portion of the second major surface 504. If desired the second susceptor panel 542 may be generally square or generally rectangular. Moreover, the second susceptor panel 542 may include chamfered corner regions so that its perimeter more closely approaches the extent of the removable portion of the surface 504.

The third and fourth susceptor surfaces 541, 541' are preferably located to be on the inner front panel 510. The third and fourth susceptor surfaces 541, 541' may be affixed to the front panel 510 in the manner described above with respect to the first and second susceptors. The third and fourth susceptor surfaces 541, 541' may be generally rectangular with dimensions sufficient to substantially cover the inner front panel 510 such that the perimeter of the inner front panel 510 and the perimeter of the third and fourth susceptor surfaces 541, 541' are spaced from one another in the range of about 0.125 to about 0.375 inches.

The fifth susceptor surface 543 is preferably located on the back panel 512 and may be affixed to the back panel 512 in the manner described above in connection with the other susceptor panels. The fifth susceptor surface 543 may be generally rectangular with dimensions sufficient to substantially cover the back panel 512 while leaving a clearance in the range of about 0.125 to about 0.375 inches between the perimeter of the back panel 512 and the perimeter of the fifth susceptor surface 543.

Each of the susceptor surfaces can be formed of any suitable microwave-active material as discussed in detail above.

To assemble the package, the inner side panels 506, 508, the inner front panel 510, and the back panel 512 are folded relative to the first major surface 500 so that the first susceptor 540 is located at the bottom of the partially assembled carton. The tabs 214, 214', 215, 215' are then attached to the corresponding interior surface of the corresponding inner side panel 506, 508 so that a self-supporting tray is formed with an integral lid. A food product, that has been enclosed and sealed in an external package, is then deposited in the partially assembled carton. The external package for the food product may, for example, comprise a clear food-grade film material. The dimensions of the food product and the carton blank have been selected such that the food product is received in the partially assembled carton so that dimensions of the food product are substantially coextensive with the first susceptor 540, and are spaced from the back panel 512 and the susceptor surface 543.

The filled, partially assembled package is subsequently closed and sealed. In particular, the second major surface 502 is folded along the fold line defined between the second major surface 504 and the rear panel 512 so that the second major surface 502 is positioned overlying the tray portion of the package. Thereafter, the outer side panels 518, 520 folded into overlying relationship with the corresponding inner side panels 506, 508 and are sealed and/or attached thereto. Either before or after the side panels for folded and/or sealed, the inner front panel 510 is folded upwardly along the crease line defined between the inner front panel 510 and the first panel portion 500. The outer front panel 530 is folded downwardly along the crease line defined so that the outer front panel 530 overlies the inner front panel portion 510.

In certain broad aspects, this invention concerns the use of a contact susceptor in combination with a plurality of non-contact susceptors to substantially surround a food product to be heated, where the non-contact susceptors function to reflect incident microwave radiation away from the food product and to convert microwave radiation to thermal radiation directed toward one or more surface portions of the food product. Accordingly, it will be appreciated that, while the description herein has been directed to a carton having generally rectangular prism form, the carton could also have other shapes and still fall within the spirit and scope of this disclosure. By way of example, packages which are polygonal, arcuate, curved or circular when viewed from above are within the spirit and scope of this disclosure. To similar effect, cross-sectional shape of the package may also have configurations other than the generally rectangular shape shown and described above.

In this specification, the word "about" is often used in connection with a numerical value to indicate that mathematical precision of such value is not intended. Accordingly, it is intended that where "about" is used with a numerical value, a tolerance of 10% is contemplated for that numerical value.

Moreover, when the words "generally" and "substantially" are used in connection with geometric shapes, it is intended that precision of the geometric shape is not required but that latitude for the shape is within the scope of the disclosure. When used with geometric terms, the words "generally" and "substantially" are intended to encompass not only features which meet the strict definitions but also features which fairly approximate the strict definitions While the foregoing describes in detail a microwaveable carton having multiple focused susceptors, methods of making the carton, and methods of use, it will be apparent to one skilled in the art that various changes and modifications may be made to the disclosed carton and methods and further that equivalents may be employed, which do not materially depart from the spirit and scope of the invention. Accordingly, all such changes, modifications, and equivalents that fall within the spirit and scope of the invention as defined by the appended claims are intended to be encompassed thereby.

We claim:

1. A carton having multiple susceptors comprising:

a blank comprising a bottom panel, a top panel, a back panel, side panels, and an inner front panel;

multiple susceptors;

each of the bottom panel and the top panel having one of said multiple susceptors; and the multiple susceptor of top panel providing greater coverage of the top panel than the multiple susceptor of bottom panel, whereby the top panel can provide more radiant heating of a food product and less exposure to microwaves than the bottom panel, wherein the carton having multiple susceptors is configured to provide at least two different heating configurations and at least two different heating methods, wherein when the carton is in a first configuration the top panel is in a closed position in relation to the bottom panel such that a food product is arranged between spaced apart susceptors of the top and bottom panels and when the carton is in a second configuration, the top panel is removed and inverted and is operable to support a food product such that a food product is arranged above adjacent susceptors of the top and bottom panels, wherein the carton includes a non-contact space between a food product and the top panel, back panel, side panels, and inner front panel of the carton and the non-contact space ranges in height from about 0.125 inch to about 0.75 inch when the carton is in the first configuration, wherein, in said first configuration, certain of said multiple susceptors are spaced from a food product by the non-contact space and are arranged to provide sufficient coverage so to provide heating of a food product disposed in the carton mainly by radiant heat, and wherein, in said second configuration, a back-to-back arrangement of the top and bottom panels is structured and arranged so that the susceptor of the bottom panel reduces heat loss from the susceptor of the top panel away from the food product and subjects a bottom of the food product to a heating temperature sufficient for crisping.

2. The carton of claim 1, wherein the carton is formed of paperboard.

3. The carton of claim 1, wherein the food product is selected from the group consisting of leavened bread products, unleavened bread products, and combinations thereof.

4. The carton of claim 1, further including a food product having a bread product portion and a topping portion, where the topping portion and the bread product portion have a weight ratio of about 1:2.

5. The carton of claim 1, wherein the susceptors have an optical density of about 0.20 to about 0.28.

6. The carton of claim 1, wherein the susceptors are formed of an aluminum film.

7. The carton of claim 1, wherein the carton is a top load carton.

8. The carton of claim 1, wherein the carton is a side load carton.

9. The carton of claim 1, wherein the susceptors attain a temperature of about 250° F. to about 450° F. during heating.

10. A method of heating a food product using a package having an openable top, microwave susceptor surfaces on top and bottom panels of the package, the multiple susceptor of top panel providing greater coverage of the top panel than the multiple susceptor of bottom panel, whereby the top panel can provide more radiant heating of a food product and less exposure to microwaves than the bottom panel, and microwave susceptor surfaces on opposed front and back side panels of the package comprising the steps of:

opening the package to expose the food product;

selecting one of two heating techniques;

when the first technique is selected, closing the package to enclose the food product, applying microwave energy to the package to generate radiant heat from the susceptor surfaces directed toward the food product, so as to radiantly heat the food product while being arranged between spaced apart microwave susceptor surfaces on the top and bottom panels, when the second technique is selected, removing the openable top from the package, inverting the package so that the bottom surface faces upwardly, placing the openable top on the inverted package with the susceptor facing upwardly, placing the food product on the openable top, and applying microwave energy to the package to heat the food product to a predetermined temperature substantially with microwave energy while causing a bottom surface of the food product to be heated by conduction from the susceptor facing upwardly wherein in the bottom surface of the food product is heated while being arranged above adjacent microwave susceptor surfaces on the top and bottom panels; and after either the first or the second technique:

removing the heated food product from within or atop the package for serving, wherein the package includes a non-contact space between the food product and the top panel, back panel, front and back side panels and the non-contact space ranges in height from about 0.125 inch to about 0.75 inch when the carton the first technique is selected, and wherein, in said first technique, certain susceptor surfaces are spaced from the food product by the non-contact space are arranged to provide sufficient coverage so to provide heating of the food product disposed in the package mainly by radiant heat, and wherein, in said second technique, a back-to-back arrangement of the top and bottom panels is structured and arranged so that the susceptor of the bottom panel reduces heat loss from the susceptor of the top panel away from the food product and subjects a bottom of the food product to a heating temperature sufficient for crisping.

11. The method of claim 10, wherein in the first technique, the susceptor of the bottom panel is operable to engage a bottom surface of a food product and in the second technique, the susceptor of the top panel is operable to engage a bottom surface of a food product.

12. A method of making a carton having multiple susceptors comprising:

forming a blank comprising a bottom panel, a top panel, a back panel, side panels, and an inner front panel; and applying multiple susceptors to the blank such that at least the bottom panel and the top panel have one of said multiple susceptors, wherein the susceptor of the top panel is structured and arranged to provide more radiant heating of a food product and less exposure to microwaves than the susceptor of the bottom panel, wherein the carton having multiple susceptors is configured to provide at least two different heating configurations and at least two different heating methods, wherein when the carton is in a first configuration the top panel is in a closed position in relation to the bottom panel such that a food product is arranged between spaced apart susceptors of the top and bottom panels and when the carton is in a second configuration, the top panel is removed and inverted and is operable to support a food product such that a food product is arranged above adjacent susceptors of the top and bottom panels, wherein the carton includes a non-contact space between the food product and the top panel, back panel, side panels, and inner front panel of the carton and the non-contact space ranges in height from about 0.125 inch to about 0.75 inch when the carton is in the first configuration, and wherein, in said first configuration, certain susceptors are spaced from the food product by the non-contact space are arranged to provide sufficient coverage so to provide heating of the food product disposed in the package mainly by radiant heat, and wherein, in said second configuration, a back-to-back arrangement of the top and bottom panels is structured and arranged so that the susceptor of the bottom panel reduces heat loss from the susceptor of the top panel away from the food product and subjects a bottom of the food product to a heating temperature sufficient for crisping.

13. The method of claim 12, further comprising utilizing susceptors on side panels of the carton.

14. A carton having multiple susceptors comprising:

a blank comprising a bottom panel, a top panel, a back panel, side panels, and an inner front panel;

a first susceptor arranged adjacent the bottom panel;

a second susceptor arranged adjacent the top panel and being operable to provide a higher radiant heating and a lower exposure to microwaves to a food product than the first susceptor;

a shape of the first susceptor of the bottom panel having a larger area than a shape of the second susceptor of the top panel;

an area of the second susceptor of the top panel being smaller in area than a removable portion of the top panel;

a third susceptor arranged adjacent the inner front panel;

a fourth susceptor arranged adjacent the back panel;

the second, third and fourth susceptors are configured to attain a temperature in the carton of between 250 degrees F. and 450 degrees F.; and the first susceptor being patterned and configured differently from the second, third and fourth susceptors so as to allow a food product to have higher exposure to microwaves via the bottom panel than via each of the top panel, the inner front panel and the back panel, wherein the carton is configured to provide at least two different heating configurations such that:

when the carton is in a first heating configuration, the top panel is in a closed position in relation to the bottom panel, a food product is supported on the bottom panel, and a non-contact space is provided between a food product and the top panel, the back panel, the side panels, and the inner front panel, and in said first heating configuration, said second, third and fourth susceptors are arranged to provide sufficient coverage so to provide heating of a food product disposed in the carton mainly by radiant heat and said first susceptor is arranged to provide coverage so as to provide a lower amount of heating of a food product in an area of the bottom panel, when the carton is in a second heating configuration, the carton is inverted after removal of the removable portion of the top panel, the removable portion of the top panel is placed atop the inverted carton, and a food product rests atop of the removable portion of the top panel such that second susceptor faces upwards and the first susceptor faces downwards, and wherein, in said second heating configuration, a back-to-back arrangement of the top and bottom panels is structured and arranged so that the first susceptor of the bottom panel reduces heat loss from the second susceptor of the top panel away from the food product, subjects a bottom of the food product to a heating temperature sufficient for crisping and can reach a temperature of about 425 degrees F.

15. The carton of claim 14, wherein the second susceptor has a different shape than the first susceptor and the second susceptor comprises a perimeter that is shorter in length than a perimeter of the first susceptor and that is entirely disposed within cut lines such that no part of the second susceptor extends out past an outer edge of the removable top panel.

* * * * *